US009606494B2

(12) United States Patent
Kogusuri et al.

(10) Patent No.: US 9,606,494 B2
(45) Date of Patent: Mar. 28, 2017

(54) PRINTING CONTROL DEVICE AND PRINTING CONTROL SYSTEM THAT GENERATE TONER-SCATTERING PREVENTION PLANE DATA

(71) Applicants: Yuji Kogusuri, Kanagawa (JP); Takanori Itoh, Kanagawa (JP); Yuichi Habu, Ibaraki (JP); Hiroaki Suzuki, Chiba (JP)

(72) Inventors: Yuji Kogusuri, Kanagawa (JP); Takanori Itoh, Kanagawa (JP); Yuichi Habu, Ibaraki (JP); Hiroaki Suzuki, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/483,745

(22) Filed: Sep. 11, 2014

(65) Prior Publication Data

US 2015/0110535 A1 Apr. 23, 2015

(30) Foreign Application Priority Data

Oct. 22, 2013 (JP) ..... 2013-219649

(51) Int. Cl.
*G03G 15/08* (2006.01)
*G03G 15/00* (2006.01)

(52) U.S. Cl.
CPC . *G03G 15/6585* (2013.01); *G03G 2215/0129* (2013.01)

(58) Field of Classification Search
CPC ..... G03G 15/6585; G03G 15/01; G03G 2215/0129
USPC ..... 399/341, 53, 82
See application file for complete search history.

(56) References Cited

U.S. PATENT DOCUMENTS

| | | | | |
|---|---|---|---|---|
| 8,526,061 | B2 | 9/2013 | Shirata | |
| 2012/0062956 | A1 | 3/2012 | Kitagawa et al. | |
| 2012/0063802 | A1* | 3/2012 | Suzuki et al. | 399/82 |
| 2012/0107007 | A1* | 5/2012 | Qiao et al. | 399/82 |
| 2012/0206742 | A1* | 8/2012 | Palomo | G09B 21/003 358/1.9 |
| 2013/0148993 | A1* | 6/2013 | Aoki et al. | 399/66 |
| 2014/0029966 | A1* | 1/2014 | Kojiri | 399/67 |
| 2015/0078769 | A1* | 3/2015 | Kogusuri | 399/39 |

FOREIGN PATENT DOCUMENTS

| | | |
|---|---|---|
| JP | 2011-142615 | 7/2011 |
| JP | 2011-254479 | 12/2011 |
| JP | 2012-064994 | 3/2012 |
| JP | 2012064994 A * | 3/2012 |
| JP | 4968902 | 4/2012 |
| JP | 5126288 | 11/2012 |

* cited by examiner

*Primary Examiner* — Benjamin Schmitt
(74) *Attorney, Agent, or Firm* — Oblon, McClelland, Maier & Neustadt, L.L.P.

(57) ABSTRACT

A printing control device includes a toner-scattering prevention plane generating unit that generates toner-scattering prevention plane data indicating that clear toner is applied to an outline drawing that is identified from target data for print; and an image-data generating unit that generates image data that includes the outline drawing by using the toner-scattering prevention plane data.

13 Claims, 24 Drawing Sheets

| GLOSS CONTROL NAME | GLOSS | DIFFERENCE |
|---|---|---|
| MIRROR GLOSS (PG) | Gs≥80 | ΔGs≤10 |
| SOLID GLOSS (G) | Gs=Gs (SOLID GLOSS) | ΔGs≤10 |
| HALFTONE DOT MATT (M) | Gs=Gs (1C30% HALFTONE DOT) | ΔGs≤10 |
| MATT (PM) | Gs≤10 | ΔGs≤10 |

| TYPE OF SURFACE EFFECT DESIGNATED BY USER | DENSITY VALUE (%) OF GLOSS CONTROL PLANE |
|---|---|
| PG | 98% |
| G | 90% |
| M | 16% |
| PM | 6% |

| DRAWING OBJECT | COORDINATES | DENSITY VALUE |
|---|---|---|
| A, B, C | (x1, y1) - (x2, y2) | 98% |
| (RECTANGLE) | (x3, y3) - (x4, y4) | 90% |
| ... | ... | ... |

FIG.12

| PLANE OUTPUT INFORMATION FROM RENDERING ENGINE | | TYPE OF CHARGING COUNTER THAT IS INSTRUCTED TO COUNT UP BY CHARGING COUNTER |
|---|---|---|
| PLANE OUTPUT INFORMATION OF CMYK COLOR PLANE DATA | PLANE OUTPUT INFORMATION OF GLOSS CONTROL PLANE DATA | |
| THERE IS OUTPUT OF AT LEAST ONE OF CMY PLANES | THERE IS OUTPUT OF GLOSS CONTROL PLANE | COLOR COUNTER AND CLEAR TONER COUNTER |
| | THERE IS NO OUTPUT OF GLOSS CONTROL PLANE | COLOR COUNTER |
| THERE IS NO OUTPUT OF ANY OF CMY PLANES | THERE IS OUTPUT OF GLOSS CONTROL PLANE | BLACK-AND-WHITE COUNTER AND CLEAR TONER COUNTER |
| | THERE IS NO OUTPUT OF GLOSS CONTROL PLANE | BLACK-AND-WHITE COUNTER |

FIG.13

| DENSITY (%) | DENSITY | | | EFFECT | GLOSSER ON/OFF (ON/OFF INFORMATION) | CLEAR-TONER PLANE 1 (PRINTER DEVICE) | CLEAR-TONER PLANE 2 (LOW-TEMPERATURE FIXING DEVICE) |
|---|---|---|---|---|---|---|---|
| | REPRESENTATIVE VALUE | RANGE OF NUMERICAL VALUES | | | | | |
| 98% | 250 | 248 | 255 | MIRROR GLOSS TYPE A | ON | INVERSE MASK A | NO DATA |
| 96% | 245 | 243 | 247 | MIRROR GLOSS TYPE B | ON | INVERSE MASK B | NO DATA |
| 94% | 240 | 238 | 242 | MIRROR GLOSS TYPE C | ON | INVERSE MASK C | NO DATA |
| 92% | 235 | 233 | 237 | ALREADY TAKEN | | | |
| 90% | 230 | 228 | 232 | SOLID GLOSS TYPE 1 | OFF | INVERSE MASK 1 | NO DATA |
| 88% | 224 | 222 | 227 | SOLID GLOSS TYPE 2 | OFF | INVERSE MASK 2 | NO DATA |
| 86% | 219 | 217 | 221 | SOLID GLOSS TYPE 3 | OFF | INVERSE MASK 3 | NO DATA |
| 84% | 214 | 212 | 216 | SOLID GLOSS TYPE 4 | OFF | INVERSE MASK 4 | NO DATA |
| 82% | 209 | 207 | 211 | ALREADY TAKEN | | | |
| 46% | 117 | 115 | 119 | ALREADY TAKEN | | | |
| 44% | 112 | 110 | 114 | WATERMARK TEXT 3 (XXX) | OFF | NO DATA | TILE TEXT 3 |
| 42% | 107 | 105 | 109 | WATERMARK TEXT 2 (COPY PROHIBITED) | | NO DATA | TILE TEXT 2 |
| 40% | 102 | 100 | 104 | WATERMARK TEXT 1 (SAMPLE) | | NO DATA | TILE TEXT 1 |
| 38% | 97 | 95 | 99 | ALREADY TAKEN | | | |
| 36% | 92 | 90 | 94 | ALREADY TAKEN | | | |
| 34% | 87 | 85 | 89 | BACKGROUND DESIGN PATTERN 3 (XXX) | | NO DATA | TILE BACKGROUND DESIGN 3 |
| 32% | 82 | 80 | 84 | BACKGROUND DESIGN PATTERN 2 (GRID) | | NO DATA | TILE BACKGROUND DESIGN 2 |
| 30% | 76 | 74 | 79 | BACKGROUND DESIGN PATTERN 1 (WAVE) | | NO DATA | TILE BACKGROUND DESIGN 1 |
| 28% | 71 | 69 | 73 | ALREADY TAKEN | | | |
| 26% | 66 | 64 | 68 | ALREADY TAKEN | | | |
| 24% | 61 | 59 | 63 | TEXTURE PATTERN TYPE 3 (ROUGH) | | NO DATA | TILE MESHED PATTERN 3 |
| 22% | 56 | 54 | 58 | TEXTURE PATTERN TYPE 2 (MEDIUM) | | NO DATA | TILE MESHED PATTERN 2 |
| 20% | 51 | 49 | 53 | TEXTURE PATTERN TYPE 1 (FINE) | | NO DATA | TILE MESHED PATTERN 1 |
| 18% | 46 | 44 | 48 | ALREADY TAKEN | | | |
| 16% | 41 | 39 | 43 | HALFTONE DOT MATT TYPE 4 | OFF | HALFTONE 4 | NO DATA |
| 14% | 36 | 34 | 38 | HALFTONE DOT MATT TYPE 3 | OFF | HALFTONE 3 | NO DATA |
| 12% | 31 | 29 | 33 | HALFTONE DOT MATT TYPE 2 | OFF | HALFTONE 2 | NO DATA |
| 10% | 25 | 23 | 28 | HALFTONE DOT MATT TYPE 1 | OFF | HALFTONE 1 | NO DATA |
| 8% | 20 | 18 | 22 | ALREADY TAKEN | | | |
| 6% | 15 | 13 | 17 | MATT TYPE C | ON&OFF | NO DATA | SOLID |
| 4% | 10 | 8 | 12 | MATT TYPE B | ON&OFF | NO DATA | SOLID |
| 2% | 5 | 1 | 7 | MATT TYPE A | ON&OFF | NO DATA | SOLID |
| 0% | 0 | 0 | 0 | NOTHING | OFF | NO DATA | NO DATA |

PRINTING CONTROL DEVICE AND PRINTING CONTROL SYSTEM THAT GENERATE TONER-SCATTERING PREVENTION PLANE DATA

CROSS-REFERENCE TO RELATED APPLICATIONS

The present application claims priority to and incorporates by reference the entire contents of Japanese Patent Application No. 2013-219649 filed in Japan on Oct. 22, 2013. The present document incorporates by reference the entire contents of Japanese Patent Application No. 2013-054361 filed in Japan on Mar. 15, 2013.

BACKGROUND OF THE INVENTION

1. Field of the Invention

The present invention relates to a printing control device and a printing control system.

2. Description of the Related Art

When the image of an outline character filled with white or not filled (hereinafter, "a white-on-color character") is formed, a phenomenon sometimes occurs such that the toner that is used to form the background image of the white-on-color character falls upon the white-on-color character (referred to as "toner scattering"). Particularly, if the character size of a white-on-color character is small and if the toner density of a background color is high, toner scattering is noticeable. To prevent the above phenomenon, there is an already-known technology as in, for example, Japanese Patent Application Laid-open No. 2011-254479, that is, if the background color is dark, an image is formed by making light the color of the area of 1 to 2 dots of the background that is adjacent to the white-on-color character in order to prevent toner scattering over the white-on-color character. There still remains the problem in that the color of the background is purposefully changed from the color that is desired by a user.

However, the devices with the above-described conventional technology purposefully changes the color, size, or the like, of a drawing object, such as a background color, into a color that is different from the color that is desired by a user; thus, there is a problem in that images are formed in such a state that the user's intentions are not adequately involved.

Therefore, there is a need to provide a printing control device and a printing control system that make it possible to prevent toner scattering over a white-on-color line drawing while the color, size, or the like, of a drawing object is obtained as a user intended.

SUMMARY OF THE INVENTION

It is an object of the present invention to at least partially solve the problems in the conventional technology.

According to an embodiment, there is provided a printing control device that includes a toner-scattering prevention plane generating unit that generates toner-scattering prevention plane data indicating that clear toner is applied to an outline drawing that is identified from target data for print; and an image-data generating unit that generates image data that includes the outline drawing by using the toner-scattering prevention plane data.

According to another embodiment, there is provided a printing control device that includes a toner-scattering prevention plane generating unit that generates toner-scattering prevention plane data indicating that white toner is applied to an outline drawing that is identified from target data for print; and an image-data generating unit that generates image data that includes the outline drawing by using the toner-scattering prevention plane data.

According to still another embodiment, there is provided a printing control system that includes a toner-scattering prevention plane generating unit that generates toner-scattering prevention plane data indicating that clear toner is applied to an outline drawing that is identified from target data for print; and an image-data generating unit that generates image data that includes the outline drawing by using the toner-scattering prevention plane data.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12 is a diagram that illustrates the relationship between plane output information and the type of charging counter that counts up;

FIG. 13 is a table that illustrates an example of the data structure of a surface-effect selection table;

DETAILED DESCRIPTION OF THE PREFERRED EMBODIMENTS

A detailed explanation is given below, with reference to the attached drawings, of an embodiment of a printing control device, a printing control system, a printing control method, and a program.

First Embodiment

Figure 1:
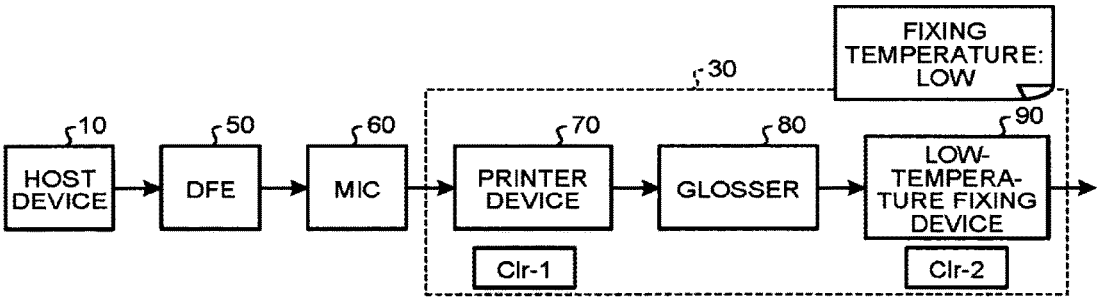
FIG. 1 is a diagram that illustrates a configuration of an image forming system according to a first embodiment.

First, an explanation is given, with reference to FIG. 1, of a configuration of an image forming system according to a first embodiment. In the present embodiment, the image forming system is configured such that a printer control device (DFE: Digital Front End) 50 (hereafter, referred to as the "DFE 50"), an interface controller (MIC: Mechanism I/F controller) 60 (hereafter, referred to as the "MIC 60"), a printer device 70, and a glosser 80 and a low-temperature fixing device 90, which are post handling devices, are connected. The DFE 50 communicates with the printer device 70 via the MIC 60 so as to control image formation of the printer device 70. Furthermore, the DFE 50 is connected to a host device 10, such as a personal computer (PC), so that the DFE 50 receives image data (print target data) from the host device 10, uses the image data to generate image data with which the printer device 70 forms a toner image corresponding to each toner of CMYK and clear toner, and transmits it to the printer device 70 via the MIC 60. The printer device 70 is provided with at least each toner of CMYK and clear toner, and an image forming unit that includes a photosensitive element, a charge device, a developing device, and a photosensitive-element cleaner, an exposure device, and a fixing device are installed for each toner.

The printer device 70, the glosser 80, and the low-temperature fixing device 90 constitute a printing device 30.

Here, the clear toner is transparent (colorless) toner that does not contain coloring material. Furthermore, transparency (colorlessness) means that, for example, the transmittance is equal to or more than 70%.

In the printer device 70, a light beam is emitted by the exposure device on the basis of the image data that is transmitted from the DFE 50 via the MIC 60, a toner image corresponding to each toner is formed on the photosensitive element, it is transferred onto a sheet that is a recording medium, and it is fixed by the fixing device that applies pressure and heat of a temperature (normal temperature) in a predetermined range. Thus, an image is formed on the sheet. As the above configuration of the printer device 70 is well known, a detailed explanation thereof is omitted here. Furthermore, a sheet is an example of a recording medium, and the recording medium is not limited to this. For example, an artificial sheet, vinyl sheet, or the like, is applicable as a recording medium.

The glosser 80 is controlled so as to be turned on or off in accordance with the on/off information that is specified by the DFE 50 and, if it is turned on, the image formed on a sheet by the printer device 70 is pressed with a high temperature and a high pressure and is then cooled down, and the sheet with the image formed thereon is separated from the main body. Thus, with regard to the pixels that are on the entire image formed on a sheet and that have equal to or more than a predetermined amount of toner adhering thereto, the total amount of toner that adheres to the pixels is uniformly compressed. The low-temperature fixing device 90 is provided with an image forming unit that includes the photosensitive element for clear toner, the charge device, the developing device, and the photosensitive-element cleaner, the exposure device, and the fixing device for fixing the clear toner, and it receives clear-toner plane image data (hereafter, sometimes referred to as the "clear-toner plane data") that is generated by the DFE 50 and that is used by the low-temperature fixing device 90 as described later. If the DFE 50 generates clear-toner plane data that is used by the low-temperature fixing device 90, the low-temperature fixing device 90 uses it to form a toner image with clear toner, overlaps the toner image on the sheet that is pressed by the glosser 80, and fixes it to the sheet with a lower temperature or pressure than usual by using a fixing device.

Here, an explanation is given of image data (original document data) that is input from the host device 10. In the host device 10, image data is generated by a previously installed image processing application and is transmitted to the DFE 50. This type of image processing application is capable of handling the image data on a special color plane in addition to the image data that defines, on a pixel by pixel basis, the value of the density (hereafter, referred to as the density value) of each color on each color plane, such as an RGB plane or CMYK plane. A special color plane is the image data for attaching special toner or ink, such as white, gold, or silver, other than the basic colors of CMYK, RGB, or the like, and it is the data intended for printers that are provided with such a special toner or ink. A special color plane is sometimes R that is added to the basic CMYK colors or Y that is added to the basic RGB colors in order to improve color reproducibility. Typically, clear toner is also treated as one of the special colors.

According to the present embodiment, clear toner, which is a special color, is used to produce the surface effect that is the visual or tactual effect that is applied to a sheet and to form a transparent image, such as a watermark or texture, other than the above-described surface effect on a sheet.

Therefore, the image processing application of the host device 10 generates, with respect to the input image data, the image data on a gloss control plane (hereinafter, sometimes referred to as the "gloss-control plane data") and/or the image data on a clear plane (hereafter, sometimes referred to as the "clear plane data") as the image data on a special color plane in addition to the image data on a color plane (hereafter, sometimes referred to as the "color plane data") in accordance with a user's designation.

Figure 2:
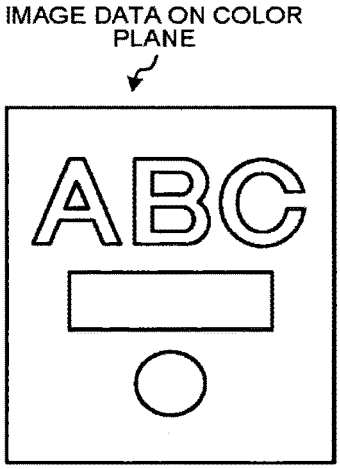
FIG. 2 is a diagram that illustrates an example of the image data on a color plane.

Here, the color plane data is the image data that defines the density value of a color image, such as RGB or CMYK, on a pixel by pixel basis. In the color plane data, 1 pixel is represented by using 8 bits in accordance with the user's designation of a color. FIG. 2 is an explanatory diagram that illustrates an example of the color plane data. In FIG. 2, the density value that corresponds to the color that is designated by a user in the image processing application is assigned to each drawing object, such as "A", "B", or "C".

Furthermore, the gloss-control plane data is the image data that, in order to control adhesion of clear toner that corresponds to the surface effect that is the visual or tactual effect applied to a sheet, specifies the area to which the surface effect is applied and the type of surface effect.

In the gloss control plane, as is the case with a color plane of RGB, CMYK, or the like, each pixel is represented by using the density value of 8 bits in the range from 0 to 255, and the density value is related to the type of surface effect (the density value may be represented by using 16 bits or 32 bits, or 0 to 100%). Furthermore, the same value is set to the area to which the same surface effect is applied regardless of the density of clear toner that actually adheres thereto; therefore, even if there is no data that indicates the area, the area can be easily specified by using the image data as needed. Specifically, the gloss control plane represents the type of surface effect and the area to which the surface effect is applied (the data that represents the area may be separately provided).

Here, the host device 10 sets the type of surface effect for the drawing object that is designated by a user in the image processing application as the density value that is the gloss control value for each drawing object and generates gloss-control plane data with a vector format.

Each pixel included in the gloss-control plane data corresponds to a pixel of the color plane data. Furthermore, the density value that is represented by each pixel in each image data is the pixel value. Furthermore, both the color plane data and the gloss-control plane data are configured on a per page basis.

The type of surface effect broadly includes the surface effect related to the presence or absence of gloss, protection of the front surface, watermark with information embedded, texture, or the like. As illustrate in FIG. 3, the surface effect related to the presence or absence of gloss broadly includes four types, i.e., in descending order of the degree of gloss (glossiness), the types, such as mirror gloss (PG: Premium Gloss), solid gloss (G: Gloss), halftone dot matt (M: Matt), and matt (PM: Premium Matt). Hereafter, the mirror gloss is sometimes referred to as "PG", the solid gloss as "G", the halftone dot matt as "M", and the matt as "PM".

Figures 3, 4:
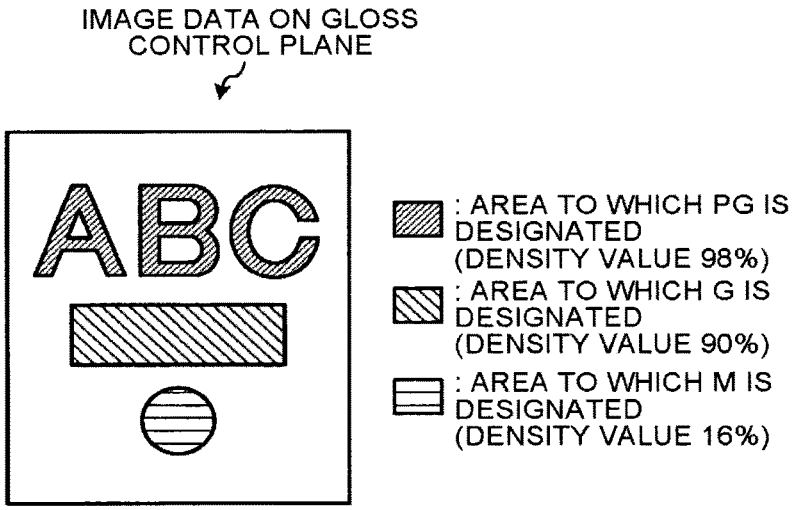
FIG. 3 is a table that illustrates the types of surface effect that is related to the presence or absence of gloss.
FIG. 4 is a diagram that illustrates, as an image, the image data on the gloss control plane.

The mirror gloss and the solid gloss have the higher degree of gloss to be applied, while the halftone dot matt and the matt are used to reduce gloss, particularly, the matt is used to produce a lower degree of gloss than that of regular sheets. In FIG. 3, the mirror gloss represents the glossiness Gs of equal to or more than 80, the solid gloss represents the solid glossiness that is made by a primary color or secondary color, the halftone dot matt represents the glossiness of a primary color and a halftone dot of 30%, and the matt represents the glossiness of equal to or less than 10. Furthermore, the difference in the glossiness is represented by using ΔGs, and it is equal to or less than 10. With regard to the various types of surface effect, a higher density value is related to the surface effect for which the degree of applied gloss is high, and a low density value is related to the surface effect that reduces gloss. The intermediate density value is related to the surface effect, such as watermark or texture. For example, characters or background design are used as the watermark. Texture represents characters or design and is capable of applying the tactual effect in addition to the visual effect. For example, a stained-glass pattern can be produced by using clear toner. The mirror gloss or the solid gloss is substituted for front surface protection. Furthermore, a user designates, via the image processing application, the area to which the surface effect is applied in the image represented on the basis of the image data that is the object to be processed or the type of surface effect that is applied to the area. In the host device 10 that executes the image processing application, the density value that corresponds to the surface effect designated by a user is set to a drawing object that is included in the area designated by the user, whereby the gloss-control plane data is generated. The correspondence relationship between the density value and the type of surface effect is described later.

FIG. 4 is an explanatory diagram that illustrates an example of the gloss-control plane data. In the example of the gloss control plane illustrated in FIG. 4, a user applies the surface effect "PG (mirror gloss)" to the drawing object "ABC", the surface effect "G (solid gloss)" to the drawing object "(rectangular graphic)", and the surface effect "M (halftone dot matt)" to the drawing object "(circular graphic)". The density value that is set to each surface effect is the density value that is defined in accordance with the type of surface effect in a density-value selection table (see FIG. 6) that is described later.

Figures 5, 6:
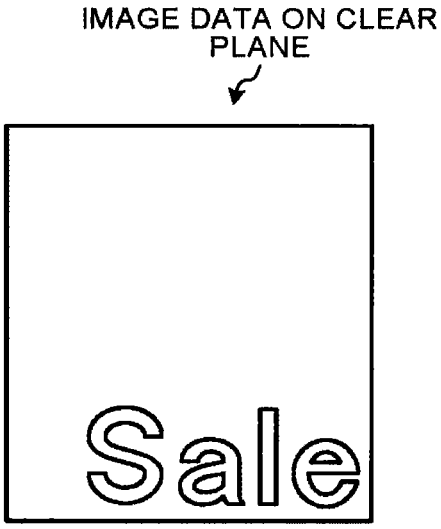
FIG. 5 is a diagram that illustrates an example of the image data on a clear plane.
FIG. 6 is a table that illustrates an example of a density-value selection table.

Clear plane data is the image data for specifying a transparent image, such as watermark or texture, other than the above-described surface effects. FIG. 5 is an explanatory diagram that illustrates an example of the clear plane data. In the example of FIG. 5, a user designates the watermark "Sale".

Thus, the gloss-control plane data and the clear plane data, which are the image data on special color planes, are generated by the image processing application of the host device 10 using a different plane from that of the color plane data. Furthermore, the format that is used in each of color plane data, gloss-control plane data, and clear plane data is the Portable Document Format (PDF), and the PDF image data on each of the planes is combined so as to be generated as original document data. Furthermore, the data format of the image data of each plane is not limited to the PDF, and any format may be used.

Here, the image processing application of the host device 10 converts the type of surface effect designated by a user into a density value and generates gloss-control plane data. This conversion is performed by referring to the density-value selection table that is previously stored in a storage unit of the host device 10. The density-value selection table is the table data in which the type of surface effect is related to the density value of the gloss control plane that corresponds to the type of surface effect. FIG. 6 is a table that illustrates an example of the density-value selection table. In the example of FIG. 6, the density value of the gloss control plane that corresponds to the area for which "PG" (mirror gloss) is designated by a user is the pixel value corresponding to 98%, the density value of the gloss control plane that corresponds to the area for which "G" (solid gloss) is designated is the pixel value corresponding to 90%, the density value of the gloss control plane that corresponds to the area for which "M" (halftone dot matt) is designated is the pixel value corresponding to 16%, and the density value of the gloss control plane that corresponds to the area for which "PM" (matt) is designated is the pixel value corresponding to 6%.

The density-value selection table is the same data as the surface-effect selection table (which is described later) that is stored in the DFE 50, and a control unit of the host device 10 acquires the surface-effect selection table at a predetermined timing, generates (copies) it from the acquired surface-effect selection table, and stores it in a storage unit. Here, FIG. 6 illustrates an example of the density-value selection table in a simple manner; however, the density-value selection table is actually the same table as the surface-effect selection table of FIG. 13. Furthermore, a configuration may be such that the surface-effect selection table is stored in a storage server (cloud) on a network, such as the Internet, and the control unit acquires the surface-effect selection table from the server and generates (copies) it from the acquired surface-effect selection table. Moreover, the surface-effect selection table stored in the DFE 50 needs to be the same data as the surface-effect selection table stored in the storage unit of the host device.

Figures 7, 8:
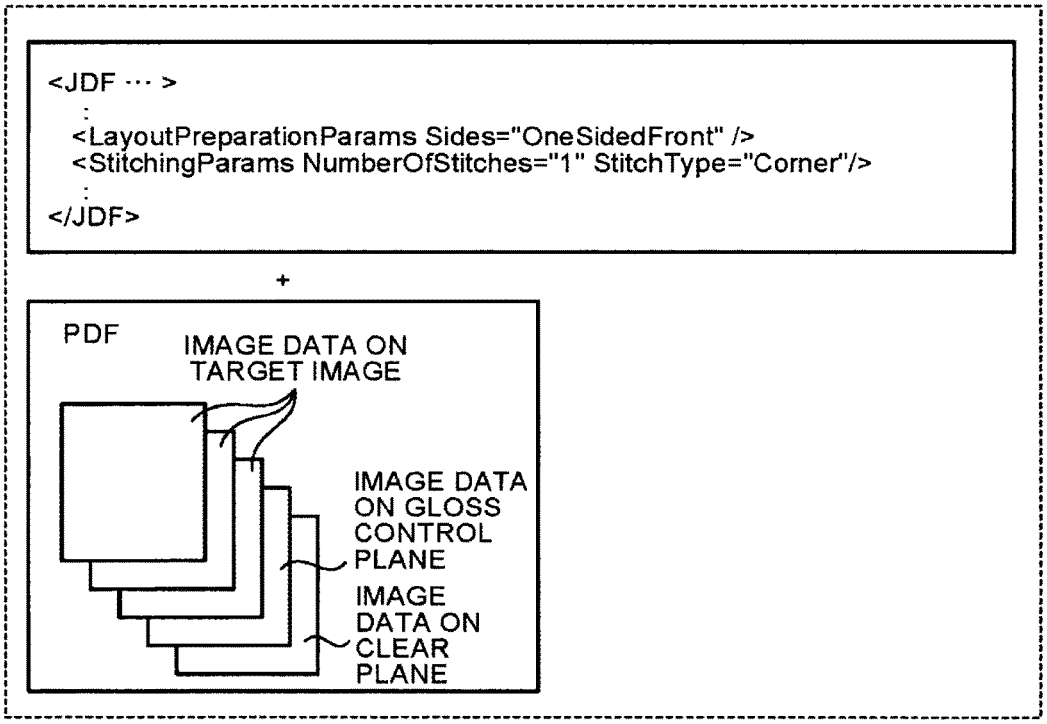
FIG. 7 is a table that illustrates the correspondence relationship among a drawing object, the coordinates, and the density value in the image data on the gloss control plane of FIG. 4.
FIG. 8 is a schematic diagram that conceptually illustrates an exemplary configuration of print data.

Specifically, the image processing application of the host device 10 refers to the density-value selection table illustrated in FIG. 6 and sets the density value (gloss control value) of the drawing object for which a predetermined surface effect is designated by a user to the value that corresponds to the type of surface effect, thereby generating gloss-control plane data. For instance, it is assumed that a user makes a designation such that, in the target image that is the color plane data illustrated in FIG. 2, "PG" is applied to the area where "ABC" is displayed, "G" to the rectangular area, and "M" to the circular area. In this case, the host device 10 refers to the density-value selection table so as to set the density value of the drawing object ("ABC") for which "PG" is designated by the user to the pixel value corresponding to 98%, set the density value of the drawing object ("rectangle") for which "G" is designated to the pixel value corresponding to 90%, and set the density value of the drawing object ("circle") for which "M" is designated to the pixel value corresponding to 16%, thereby generating gloss-control plane data. The gloss-control plane data generated by the host device 10 is the vector-format data that is represented as a set of the coordinates of a point, a parameter of an equation for the line that connects therebetween and a plane, and a drawing object that represents painting, special effect, or the like. FIG. 4 is a diagram that illustrates the gloss-control plane data as an image, and FIG. 7 is a table that illustrates the correspondence relationship among the drawing object, the coordinates, and the density value in the gloss-control plane data of FIG. 4.

The host device 10 generates original document data that combines the gloss-control plane data, the image data (color plane data) on a target image, and the clear plane data.

The host device 10 then generates print data on the basis of the original document data. The print data includes the image data (color plane data) on a target image, gloss-control plane data, clear plane data, and a job command for designating, to a printer, for example, the settings of a printer, the setting for combining, or the setting for two sides. FIG. 8 is a schematic diagram that conceptually illustrates an exemplary configuration of the print data. In the example of FIG. 8, the Job Definition Format (JDF) is used as a job command; however, this is not a limitation. The JDF illustrated in FIG. 8 is a command for designating "one-sided printing, with staples" as the settings for combining. Furthermore, the print data may be converted into a page description language (PDL), such as PostScript (registered trademark) or may be the PDF format if the DFE 50 is in conformity to it.

Figure 9:
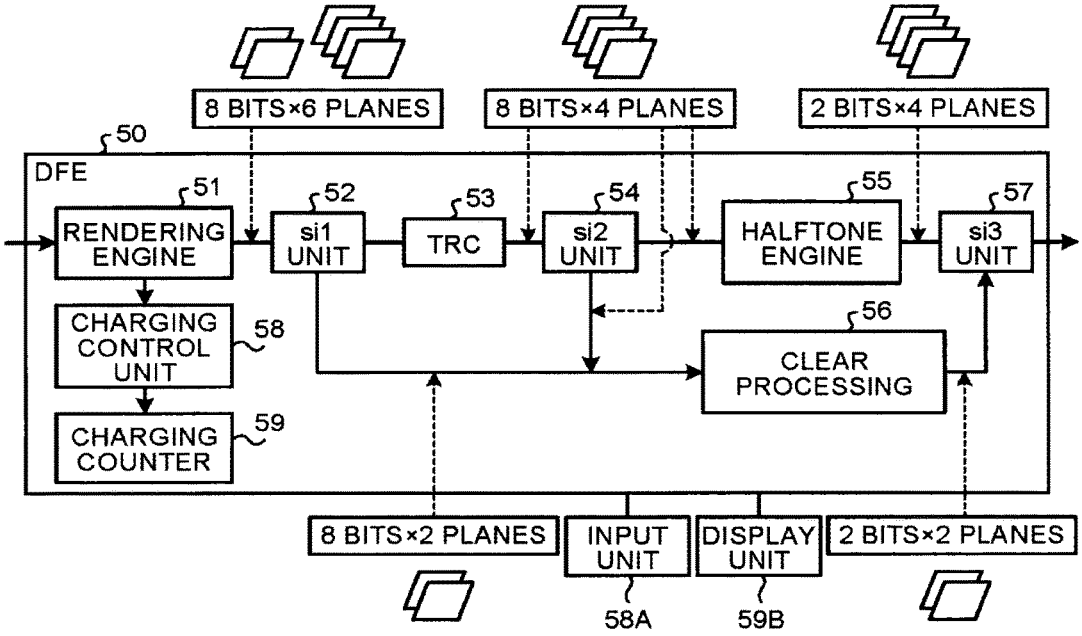
FIG. 9 is a diagram that illustrates a functional configuration of a DFE.

Next, an explanation is given of the functional configuration of the DFE 50. As illustrated in FIG. 9, the DFE 50 includes a rendering engine 51, an si1 unit 52, a Tone Reproduction Curve (TRC) 53, an si2 unit 54, a halftone engine 55, clear processing 56, an si3 unit 57, an input unit 58A, and a display unit 59B. The rendering engine 51, the si1 unit 52, the Tone Reproduction Curve (TRC) 53, the si2 unit 54, the halftone engine 55, the clear processing 56, and the si3 unit 57 are implemented when a control unit of the DFE 50 executes various types of programs that are stored in a main storage unit or an auxiliary storage unit. Each of the si1 unit 52, the si2 unit 54, and the si3 unit 57 has a function to separate image data and a function to integrate image data.

An explanation is given below of a case where the print data includes color plane data and gloss-control plane data and it does not include clear plane data; however, a configuration may be such that the print data includes clear plane data.

The input unit 58A is an input device, such as a keyboard or a mouse. The display unit 59B is a display device, such as a display unit.

Figure 10:
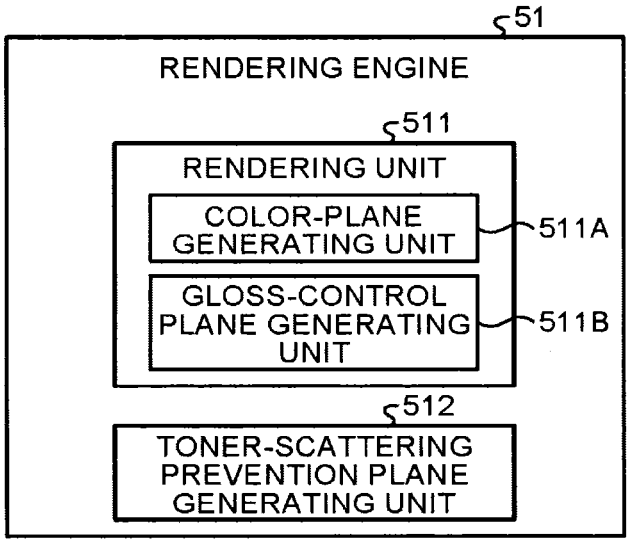
FIG. 10 is a block diagram that illustrates a functional configuration of a rendering engine according to the first embodiment.

The rendering engine 51 receives print data (the print data illustrated in FIG. 8) that is transmitted from the host device 10 and renders the print data. FIG. 10 is a block diagram that illustrates a functional configuration of the rendering engine 51. As illustrated in FIG. 10, the rendering engine 51 includes a rendering unit 511 and a toner-scattering prevention plane generating unit 512.

The rendering unit 511 performs language interpretation on the input print data and generates intermediate data that is called a display list and that is represented by using a vector format. Here, the rendering unit 511 generates the display list for each of the planes, i.e., each color plane of CMYK, the gloss control plane, and the 8-bit toner-scattering prevention plane.

Here, the rendering unit 511 represents each display list of CMYK in a state where the color space that is represented by using the RGB format, or the like, has been converted into the color space of the CMYK format. The rendering unit 511 generates the display list of the gloss control plane such that each drawing object has the density value information as its attribute. The rendering unit 511 generates the display list of the toner-scattering prevention plane such that the drawing object of a white-on-color character is represented.

A white-on-color character represents the area where a color image is not formed by using color (CMYK) toner on a recording medium that is an image formation target. Specifically, a white-on-color character is the area to which color (CMYK) toner is not applied on a recording medium that is a formation target. Furthermore, a white-on-color character is an example of an double line or a white-on-color image (outline drawing), and it is not limited to a character.

The rendering unit 511 includes a color-plane generating unit 511A and a gloss-control plane generating unit 511B. The color-plane generating unit 511A converts the CMYK display list into a raster format and generates each 8-bit color plane data on a CMYK color plane. Furthermore, the gloss-control plane generating unit 511B converts the display list of the gloss control plane into a raster format and generates 8-bit gloss-control plane data.

Here, the rendering unit 511 converts the vector-format gloss-control plane data, which is output from the host device 10, into raster-format gloss-control plane data and, as a result, the DFE 50 sets the type of surface effect for the drawing object that is designated by a user in the image processing application as the density value on a per pixel basis and outputs the gloss-control plane data.

Furthermore, if the image data on a certain plane does not include valid data, the rendering unit 511 does not output data on the corresponding plane. If image data on a certain plane is not input, each of the units that follow the rendering engine 51, which processes image data, operates such that the image data on the plane does not include valid data.

The toner-scattering prevention plane generating unit 512 outputs 8-bit toner-scattering prevention plane image data (hereafter, referred to as the "toner-scattering prevention plane data") from the display list that has been converted into a raster format.

Toner scattering is the phenomenon where toner spills out of the intended area of the recording medium where an image is formed. This phenomenon easily occurs in the boundary between the area to which color toner is applied and the area to which it is not applied, such as the boundary between a white-on-color character and its background. Especially, toner scattering occurs in a more noticeable way if a white-on-color character is small and if the density of toner that forms the background color of a white-on-color character is high.

In the present embodiment, in order to prevent the above-described toner scattering, clear toner is applied to white-on-color characters. The toner-scattering prevention plane data is the image data for specifying a line drawing object to which color toner is not applied and for making an instruction to apply clear toner to the object.

Figure 11:
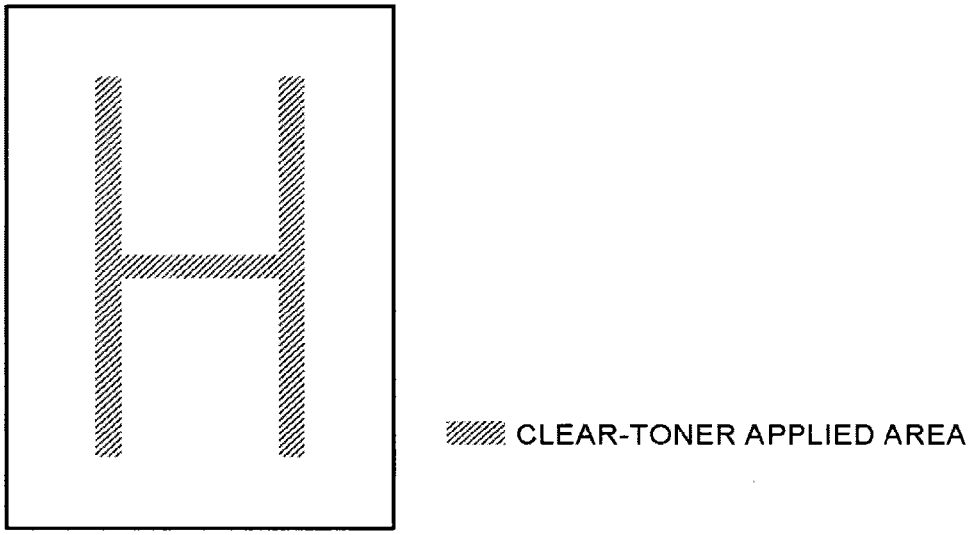
FIG. 11 is a diagram that illustrates an example of the toner-scattering prevention plane data.

FIG. 11 is a diagram that illustrates an example of the toner-scattering prevention plane data. In the toner-scattering prevention plane data, 1 pixel is represented by using 8 bits. In the present embodiment, the toner-scattering prevention plane generating unit 512 generates the toner-scattering prevention plane data such that clear toner is applied to a white-on-color character if the character size is equal to or less than a predetermined value and if the toner density of the background color is equal to or more than a predetermined value.

The example of FIG. 11 illustrates that "H" is the object to which clear toner is applied. It is assumed that the density value of applied clear toner is 100%. Thus, it is possible to apply clear toner for preventing toner scattering to only a character for which the effect of preventing toner scattering is high.

Furthermore, the toner-scattering prevention plane generating unit 512 may generate toner-scattering prevention plane data such that white toner is applied to all of the white-on-color characters. Specifically, the toner-scattering prevention plane generating unit 512 may generate toner-scattering prevention plane data such that white toner is applied even to a white-on-color character whose character size is more than a predetermined value or to a white-on-color character for which the toner density of the background color is less than a predetermined value.

Furthermore, the toner-scattering prevention plane generating unit 512 does not generate toner-scattering prevention plane data if the print data received from the host device 10 contains the information that prevents application of clear toner to a white-on-color character. This information is designated by a user when the print data is generated.

Furthermore, the rendering engine 51 notifies the plane output information on the image data that is output to a charging control unit 58.

Returning to FIG. 9, the si1 unit 52 outputs each 8-bit color plane data on CMYK to the TRC 53 and outputs, to the clear processing 56, 8-bit gloss-control plane data and 8-bit toner-scattering prevention plane data.

The TRC 53 receives each 8-bit color plane data on CMYK via the si1 unit 52. The TRC 53A performs a gamma correction by using a gamma curve of 1D_LUT that is generated by calibration on the input color plane data. Image processing includes, in addition to the gamma correction, an adjustment on the total amount of toner, or the like. The adjustment on the total amount is the operation to restrict each 8-bit color plane data on CMYK on which the gamma correction has been performed as there is a limitation on the amount of toner that can be applied by the printer device 70 to 1 pixel on a recording medium. Furthermore, if printing is performed without the adjustment on the total amount, the image quality is degraded due to a transfer failure or a fixing failure. In the present embodiment, an explanation is given of only the related gamma correction.

The si2 unit 54 outputs, to the clear processing 56, each 8-bit color plane data on CMYK, on which the TRC 53 performs the gamma correction, as the data for generating an inverse mask (which is described later). The halftone engine 55 receives each 8-bit color plane data on CMYK, on which the gamma correction has been performed, via the si2 unit 54. The halftone engine 55 performs halftone processing on the input image data so as to convert it into the data format of, for example, each CMYK color plane data of 2 bits, or the like, for output to the printer device 70 and outputs each CMYK color plane data of 2 bits, or the like, on which the halftone processing has been performed. Furthermore, 2 bits is an example, and this is not a limitation.

The clear processing 56 receives the 8-bit gloss-control plane data, which has been converted by the rendering engine 51, and the 8-bit toner-scattering prevention plane data via the si1 unit 52, and it receives, via the si2 unit 54, each 8-bit color plane data on CMYK on which the gamma correction has been performed by the TRC 53.

The charging control unit 58 determines the type of charging counter that counts up on the basis of the plane output information that is received from the rendering engine 51 and gives an instruction to a charging counter 59 to count up. The charging counter 59 causes a corresponding counter to count up in accordance with the instruction from the charging control unit 58.

In the present embodiment, it is assumed that the charging counter 59 includes three types of counters, i.e., a black-and-white counter, a color counter, and a clear toner counter. The black-and-white counter indicates the number of pages on which color toner (CMY toner) has not been used. The number of pages indicated by the black-and-white counter includes the pages of blank sheets. The color counter indicates the number of pages on which color toner (CMY toner) has been used. The clear toner counter indicates the number of pages on which clear toner has been used.

The charging control unit 58 determines the type of charging counter that counts up on the basis of the plane output information from the rendering engine 51 on a per-page basis and gives an instruction to the charging counter 59 to count up.

FIG. 12 is a diagram that illustrates the relationship between the plane output information and the type of charging counter that counts up. If there is an output of at least one of the CMY planes and if there is an output of the gloss control plane, the rendering engine 51 gives an instruction to the charging counter 59 to count up the color counter and the clear toner counter. In the same manner, if there is an output of at least one of the CMY planes and if there is no output of the gloss control plane, the rendering engine 51 gives an instruction to the color counter to count up. If there is no output of any of the CMY planes and if there is an output of the gloss control plane, the rendering engine 51 gives an instruction to the black-and-white counter and the clear toner counter to count up. If there is no output of any of the CMY planes and if there is no output of the gloss control plane, the rendering engine 51 gives an instruction to the black-and-white counter to count up.

Thus, according to the present embodiment, the charging control unit 58 is capable of causing each counter to count up properly without receiving any effects of application of clear toner by using toner-scattering prevention plane data. Specifically, it is possible to prevent charging on the clear toner that is used without user's intension.

The clear processing 56 stores the surface-effect selection table. Furthermore, the clear processing 56 receives the 8-bit gloss-control plane data that is input from the si1 unit 52.

The clear processing 56 uses the gloss-control plane data that is input from the si1 unit 52 to refer to the surface-effect selection table and determines the surface effect that corresponds to the density value (pixel value) that is indicated by each pixel included in the gloss-control plane data. Then, in accordance with the above determination, the clear processing 56 determines whether the glosser 80 is turned on or off and generates an inverse mask or a solid mask as appropriate by using the input CMYK 8-bit color plane data, thereby generating 2-bit clear-toner plane data for adhering clear toner as appropriate. Then, in accordance with a determination result of the surface effect, the clear processing 56 appropriately generates and outputs the clear-toner plane data that is used by the printer device 70 and the clear-toner plane data that is used by the low-temperature fixing device 90 and also outputs the on/off information that indicates on/off of the glosser 80.

Here, the inverse mask is used to make even the total amount of CMYK toner and clear toner in combination that adhere to each of the pixels that are included in the target area to which the surface effect is applied. Specifically, the inverse mask is the image data that is obtained by summing all of the density values that are indicated by the pixels included in the target area of the CMYK plane image data and then subtracting the summed value from a predetermined value. For example, the above-described inverse mask 1 is represented by using the following Equation (1):

$$\mathrm{Clr}=100-(C+M+Y+K) \tag{1}$$

where if Clr<0, then Clr=0.

In Equation (1), Clr, C, M, Y, and K represent the density percentage that is converted from the density value of each pixel with respect to each of the clear toner and the C, M, Y, and K toner. Specifically, by using Equation (1), the total amount of adhesion that is obtained by adding the amount of adhesion of clear toner to the total amount of adhesion of the C, M, Y, and K toner is 100% with respect to all of the pixels that are included in the target area to which the surface effect is applied. Furthermore, if the total amount of adhesion of the C, M, Y, and K toner is equal to or more than 100%, clear toner is not applied, and its density percentage is set to 0%. This is because the area where the total amount of adhesion of the C, M, Y, and K toner exceeds 100% is smoothed during a fixing operation. Thus, as the total amount of adhesion of every pixel that is included in the target area to which the surface effect is applied is equal to or more than 100%, the target area has no unevenness on its surface due to the difference in the total amount of adhesion of toner and, as a result, gloss is produced due to light regular reflection. Furthermore, the inverse mask may be obtained by using other than Equation (1), and there may be multiple types of inverse masks.

For example, the inverse mask may be used to evenly attach clear toner to each pixel. In this case, the inverse mask is also called a solid mask, and it is represented by using the following Equation (2):

$$\mathrm{Clr}=100 \tag{2}$$

Furthermore, some of the target pixels to which the surface effect is applied may be related to the density percentage other than 100%, and there may be multiple patterns of a solid mask.

Furthermore, for example, the inverse mask may be obtained by performing a multiplication of the blank-surface exposure percentage of each color. In this case, the inverse mask is represented by using the following Equation (3), for example:

$$\mathrm{Clr}=100\times\{(100-C)/100\}\times\{(100-M)/100\}\times\{(100-Y)/100\}\times\{(100-K)/100\} \tag{3}$$

In Equation (3), (100−C)/100 indicates the blank-surface exposure percentage of C, (100−M)/100 indicates the blank-surface exposure percentage of M, (100−Y)/100 indicates the blank-surface exposure percentage of Y, and (100−K)/100 indicates the blank-surface exposure percentage of K.

Furthermore, for example, the inverse mask may be obtained by using a method that assumes that the halftone dots of the maximum area percentage controls the smoothness. In this case, the inverse mask is represented by using the following Equation (4), for example:

$$\mathrm{Clr}=100-\max(C,M,Y,K) \tag{4}$$

In Equation (4), max(C,M,Y,K) indicates that the density value of the color that indicates the largest density value among CMYK is the representative value.

In short, the inverse mask is appropriate if it is represented by using any one of the above-described Equations (1) to (4).

Next, an explanation is given of the surface-effect selection table. The surface-effect selection table is the table that indicates the correspondence relationship between the density value that is the gloss control value that indicates the surface effect and the type of surface effect and that indicates the correspondence relationship among the above, the control information on a post handling device that corresponds to the configuration of the image forming system, the clear-toner plane data that is used by the printer device 70, and the clear-toner plane data that is used by the post handling device.

The image forming system may have various different configurations; however, according to the present embodiment, a configuration is such that the printer device 70 is connected to the glosser 80 and the low-temperature fixing device 90 that are the post handling devices. Therefore, the control information on the post handling device that corresponds to the configuration of the image forming system is the on/off information that indicates on/off of the glosser 80. Furthermore, the clear-toner plane data that is used by the post handling device is the clear-toner plane data that is used by the low-temperature fixing device 90.

FIG. 13 is a table that illustrates an example of the data structure of the surface-effect selection table. The surface-effect selection table may be configured such that it indicates, for each configuration of a different image forming system, the correspondence relationship among the control information on a post handling device, the image data on a clear toner plane 1 that is used by the printer device 70, the image data on a clear toner plane 2 that is used by a post handling device, the density value, and the type of surface effect; however, FIG. 13 illustrates an example of the data structure that corresponds to the configuration of the image forming system according to the present embodiment. With respect to the correspondence relationship between the type of surface effect and the density value as illustrated in FIG. 13, each type of surface effect is related to each range of density values. Furthermore, each type of surface effect is related by 2% to the percentage of density (density percentage) that is converted from the value (representative value) that is a representative in a range of density values.

Specifically, the surface effect (the mirror effect and the solid effect) for applying gloss is related to the range of density values ("212" to "255") for which the density percentage is equal to or more than 84%, and the surface effect (the halftone dot matt and the matt) for reducing gloss is related to the range of density values ("1" to "43") for which the density percentage is equal to or less than 16%. Furthermore, the surface effects, such as texture or background design watermark, are related to the range of density values for which the density percentage is 20% to 80%.

A more detailed explanation is given by using the surface-effect selection table illustrated in FIG. 13 as an example. For instance, the pixel values "238" to "255" are related to the mirror gloss (PG: Premium Gloss) as the surface effect, and different types of mirror gloss are related to the three ranges thereof, i.e., the pixel values "238" to "242", the pixel values "243" to "247", and the pixel values "248" to "255".

Furthermore, the pixel values "212" to "232" are related to the solid gloss (G: Gloss), and different types of solid gloss are related to the four ranges thereof, i.e., the pixel values "212" to "216", the pixel values "217" to "221", the pixel values "222" to "227", and the pixel values "228" to "232".

Furthermore, the pixel values "23" to "43" are related to the halftone dot matt (M: Matt), and different types of halftone dot matt are related to the four ranges thereof, i.e., the pixel values "23" to "28", the pixel value "29" to "33", the pixel values "34" to "38", and the pixel values "39" to "43". Furthermore, the pixel values "1" to "17" are related to the matt (PM: Premium Matt), and different types of matt are related to the three ranges thereof, i.e., the pixel values "1" to "7", the pixel values "8" to "12", and the pixel value "13" to "17". With respect to the different types of the identical surface effect, there is a difference in the equation for obtaining the clear-toner plane data that is used by the printer device 70 or the low-temperature fixing device 90, and the operations of the printer main body and the post handling device are the same. Furthermore, the density value "0" is related to non-application of the surface effect.

Furthermore, FIG. 13 illustrates, in relation to the pixel value and the surface effect, the on/off information that indicates on/off of the glosser 80 and the details of the image data (Clr-1 in FIG. 1) on the clear-toner plane 1 that is used by the printer device 70 and the image data on the clear-toner plane 2 that is used by the low-temperature fixing device 90. For example, the surface effect is the mirror gloss, it is indicated that the glosser 80 is turned on, the image data on the clear-toner plane 1 that is used by the printer device 70 represents an inverse mask, and the image data (Clr-2 in FIG. 1) on the clear-toner plane 2 that is used by the low-temperature fixing device 90 is not present. The inverse mask is obtained by using, for example, Equation (1). The example of FIG. 13 illustrates the case where the area for which the mirror effect is designated as a surface effect corresponds to the entire area that is specified by the image data. An explanation is given later of the case where the area for which the mirror effect is designated as a surface effect corresponds to part of the area that is specified by the image data.

Furthermore, if the density value is "228" to "232" and the surface effect is the solid gloss, it is indicated that the glosser 80 is turned off, the image data on the clear-toner plane 1 that is used by the printer device 70 is the inverse mask 1, and the image data on the clear-toner plane 2 that is used by the low-temperature fixing device 90 is not present.

Furthermore, the inverse mask 1 is appropriate if it is represented by using any one of the above-described Equations (1) to (4). As the glosser 80 is off, the total amount of adhesion of toner that is to be smoothed is different and therefore unevenness on the surface is increased due to the mirror gloss; as a result, the solid gloss that has a lower degree of gloss is produced due to the mirror gloss. Furthermore, if the surface effect is the halftone dot matt, it is indicated that the glosser 80 is turned off, the image data on the clear-toner plane 1 that is used by the printer device 70 represents halftone (halftone dot), and the image data on the clear-toner plane 2 that is used by the low-temperature fixing device 90 is not present. Furthermore, if the surface effect is the matt, it is indicated that the glosser 80 may be turned on or off, the image data on the clear-toner plane 1 that is used by the printer device 70 is not present, and the image data on the clear-toner plane 2 that is used by the low-temperature fixing device 90 represents a solid mask. The solid mask is obtained by using, for example, Equation (2).

As described above, the clear processing 56 refers to the surface-effect selection table to determine the surface effect that is related to each pixel value that is indicated by the gloss-control plane data, determines whether the glosser 80 is turned on or off, and determines which clear-toner plane data is to be used by the printer device 70 and the low-temperature fixing device 90. Furthermore, the clear processing 56 determines whether the glosser 80 is turned on or off on a per-page basis. Furthermore, as described above, in accordance with the determination result, the clear processing 56 generates and outputs clear-toner plane data as appropriate and outputs the on/off information to the glosser 80. Thus, clear-toner plane data is generated which has the gloss effect that is intended by a user in accordance with the type of sheet.

Returning to FIG. 9, the si3 unit 57 integrates each 2-bit color plane data of CMYK, on which halftone processing has been performed, with the 2-bit clear-toner plane data that is generated by the clear processing 56 and outputs the integrated image data to the MIC 60. Furthermore, as the clear processing 56 sometimes does not generate at least any one of the clear-toner plane data that is used by the printer device 70 and the clear-toner plane data that is used by the low-temperature fixing device 90, the clear-toner plane data generated by the clear processing 56 is integrated by the si3 unit 57 and, if neither sets of clear-toner plane data are generated by the clear processing 56, the si3 unit 57 outputs the image data that is obtained by integrating each 2-bit image data of CMYK. As a result, the DFE 50 sends, to the MIC 60, 4 to 6 sets of 2-bit image data. Furthermore, the si3 unit 57 outputs, to the MIC 60, the on/off information for the glosser 80 that is output from the clear processing 56.

Figure 14:
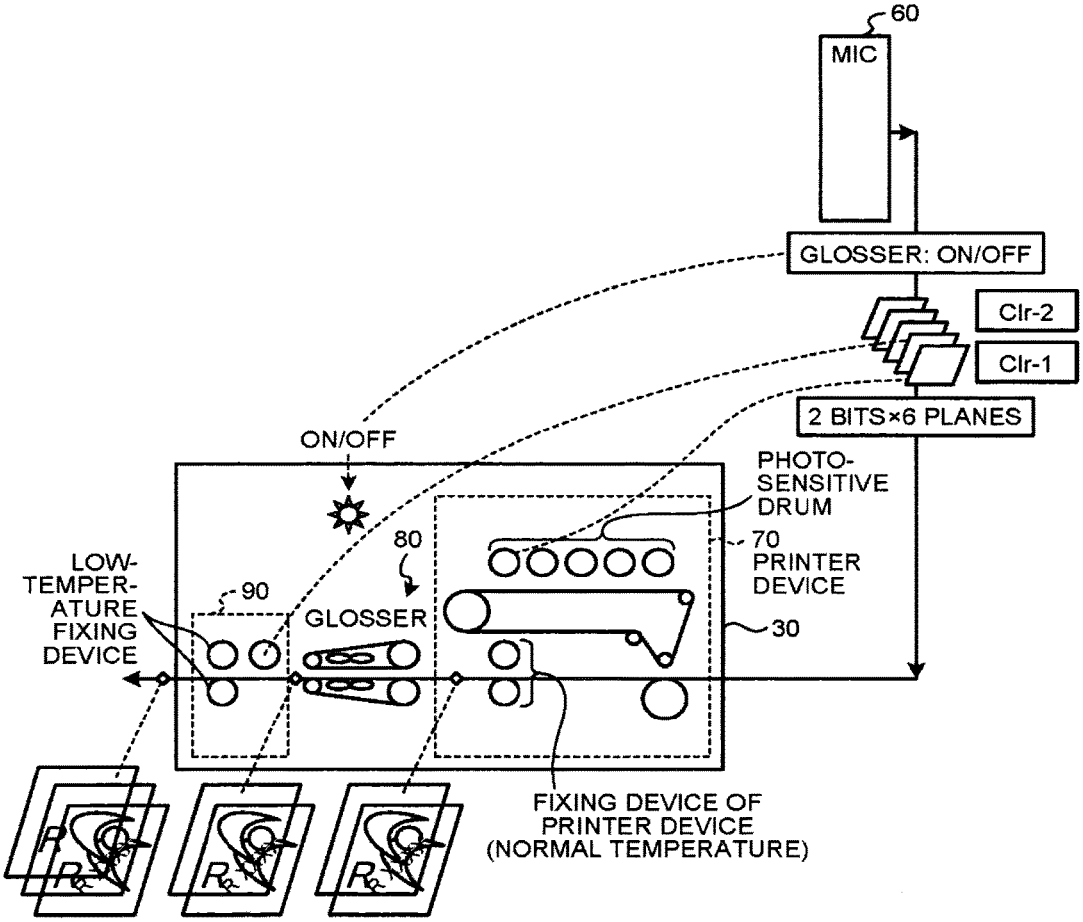
FIG. 14 is a diagram that conceptually illustrates configurations of an MIC and a printing device.

The MIC 60 is connected to the DFE 50 and the printer device 70. The MIC 60 outputs, to the DFE 50, the device configuration information that indicates the configuration of a device that is installed as a post handling device. Furthermore, the MIC 60 receives color-plane image data and clear-toner plane image data from the DFE 50, delivers each image data to a corresponding device, and controls the post handling device. More specifically, as illustrated in FIG. 14, the MIC 60 outputs, to the printer device 70, CMYK color-plane image data out of the image data that is output from the DFE 50, if there is clear-toner plane image data that is used by the printer device 70, outputs it to the printer device 70, turns on or off the glosser 80 by using the on/off information that is output from the DFE 50, and if there is clear-toner plane image data that is used by the low-temperature fixing device 90, outputs it to the low-temperature fixing device 90. The glosser 80 may switch a path where fixing is performed and a path where fixing is not performed by using the on/off information. The low-temperature fixing device 90 may be selectively turned on or off or may switch the paths in the same manner as the glosser 80 depending on the presence or absence of the image data on a clear-toner plane.

Furthermore, as illustrated in FIG. 14, the printing device 30, which includes the printer device 70, the glosser 80, and the low-temperature fixing device 90, includes a conveyance path for conveying a recording medium. Specifically, the printer device 70 includes multiple photosensitive drums of an electrophotographic system, a transfer belt onto which a toner image formed on the photosensitive drum is transferred, a transfer device that transfers the toner image on the transfer belt onto a recording medium, and a fixing device that fixes the toner image on the recording medium to the recording medium. A recording medium is conveyed through a conveyance path by a conveying member that is not illustrated so as to be sequentially conveyed through the positions where the printer device 70, the glosser 80, and the low-temperature fixing device are provided. Then, after these devices sequentially perform operations to form an image and apply a surface effect, it is conveyed through a conveyance path by a conveying mechanism that is not illustrated and is discharged from the printing device.

Therefore, if the image data output from the DFE 50 includes CMYK color plane data and clear-toner plane data, the color image that is specified by the color plane data is formed on a recording medium by using color toner, the type of surface effect that is specified by the clear-toner plane data is applied to the recording medium by using clear toner, and the transparent image that is specified by the clear-toner plane data is formed on the recording medium by using clear toner. Specifically, the surface effect is applied to a recording medium on the basis of the clear-toner plane data that includes the gloss effect, which is the effect intended by a user, in accordance with the type of sheet.

Figure 15:
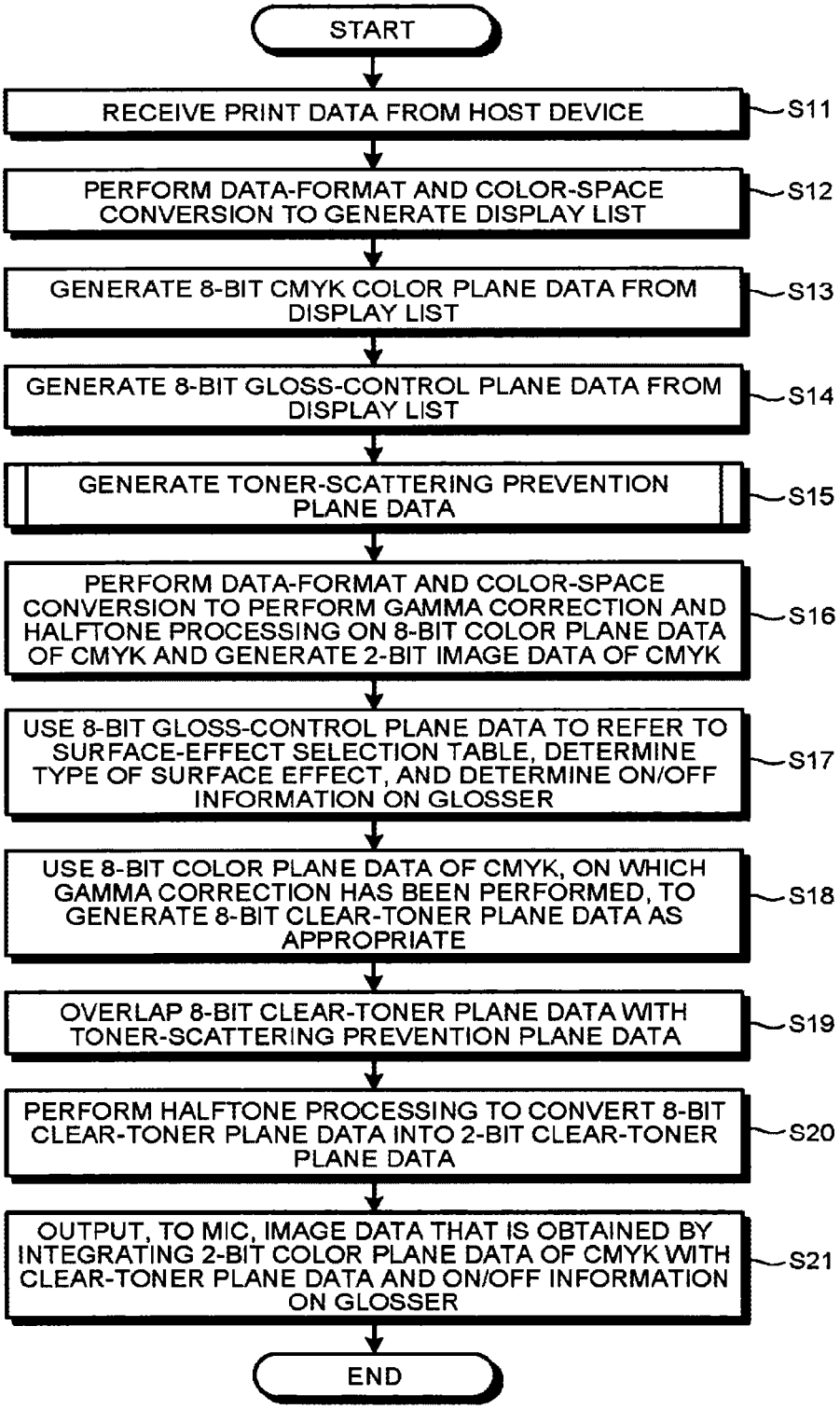
FIG. 15 is a flowchart that illustrates the steps of a gloss control operation that is performed by the image forming system according to the first embodiment.

Next, an explanation is given, with reference to FIG. 15, of the steps of a gloss control operation that is performed by the image forming system according to the present embodiment. After the DFE 50 receives print data from the host device 10 (Step S11), the rendering unit 511 of the rendering engine 51 performs language interpretation on it and performs data-format and color-space conversion so as to generate a display list (Step S12).

Next, the rendering unit 511 converts each display list of CMYK into a raster format and generates 8-bit CMYK color plane data (Step S13). Then, the rendering unit 511 converts the display list of the gloss-control plane data into a raster format and generates 8-bit gloss-control plane data (Step S14).

During the operation to convert the gloss-control plane data, the gloss-control plane data of FIG. 4, i.e., the display list of the gloss-control plane data in which the density value for specifying the surface effect is designated for each drawing object as illustrated in FIG. 7, is converted into the gloss-control plane data in which the density value is designated for each pixel that is included in a drawing object.

Specifically, the rendering engine 51 converts the gloss-control plane data by applying, to the pixels in the range of the coordinates that correspond to the drawing object in the display list of the gloss-control plane data illustrated in FIG. 7, the density value that is set to the drawing object. Thus, the gloss-control plane data is converted into gloss-control plane data in which the surface effect is set on a pixel by pixel basis.

Next, the toner-scattering prevention plane generating unit 512 generates 8-bit toner-scattering prevention plane data (Step S15). A detailed explanation is given later of an operation to generate the toner-scattering prevention plane data.

Next, after the operation to generate the toner-scattering prevention plane data is completed, the TRC 53 of the DFE 50 performs a gamma correction on each 8-bit color plane data of CMYK by using a gamma curve of 1D_LUT that is generated by calibration and outputs, to the halftone engine 55 and the clear processing 56 via the si2 unit 54, each 8-bit color plane data of CMYK on which the gamma correction has been performed. The halftone engine 55 performs halftone processing on the image data, on which the gamma correction has been performed, to convert it into the data format of each 2-bit color plane data of CMYK for output to the printer device 70 and obtains each 2-bit color plane data of CMYK on which the halftone processing has been performed (Step S16).

Next, the clear processing 56 uses the 8-bit gloss-control plane data to refer to the surface-effect selection table and determine the surface effect that is designated with respect to each pixel value that is indicated by the gloss-control plane data. Then, the clear processing 56 makes the above determination with respect to all of the pixels that are included in the gloss-control plane data. Furthermore, the gloss-control plane data basically indicates the density value in the same range with respect to all of the pixels that are included in the area to which each surface effect is applied. Therefore, the clear processing 56 determines that the pixels near the area to which it is determined that the same surface effect is applied are included in the area to which the same surface effect is applied. Thus, the clear processing 56 determines the area to which the surface effect is applied and the type of surface effect that is applied to the area. Then, the clear processing 56 determines whether the glosser 80 is turned on or off in accordance with the determination (Step S17).

Next, the clear processing 56 appropriately uses each 8-bit color plane data of CMYK, which is output from the si2 unit 54 and on which the gamma-correction has been performed, to generate 8-bit clear-toner plane data to attach clear toner as appropriate (Step S18). Furthermore, the clear processing 56 overlaps the 8-bit clear-toner plane image data with the 8-bit toner-scattering prevention plane data (Step S19). Thus, it is possible to prevent toner scattering without receiving any effect of a different drawing object that is to receive the effect of clear toner.

Then, the halftone engine 55 performs halftone processing to convert the 8-bit clear-toner plane data, which uses 8-bit image data, into 2-bit clear-toner plane data (Step S20).

Next, the si3 unit 57 of the DFE 50 integrates each 2-bit color plane data of CMYK, which is obtained at Step S16 and on which the halftone processing has been performed, with the 2-bit clear-toner plane data that is generated at Step S20 and outputs, to the MIC 60, the integrated image data and the on/off information that is determined at Step S17 and that indicates on/off of the glosser 80 (Step S21).

Furthermore, if the clear processing 56 does not generate clear-toner plane data at Step S18, only each 2-bit color plane data of CMYK, which is obtained at Step S16 and on which the halftone processing has been performed, is integrated and output to the MIC 60 at Step S21.

Figure 16:
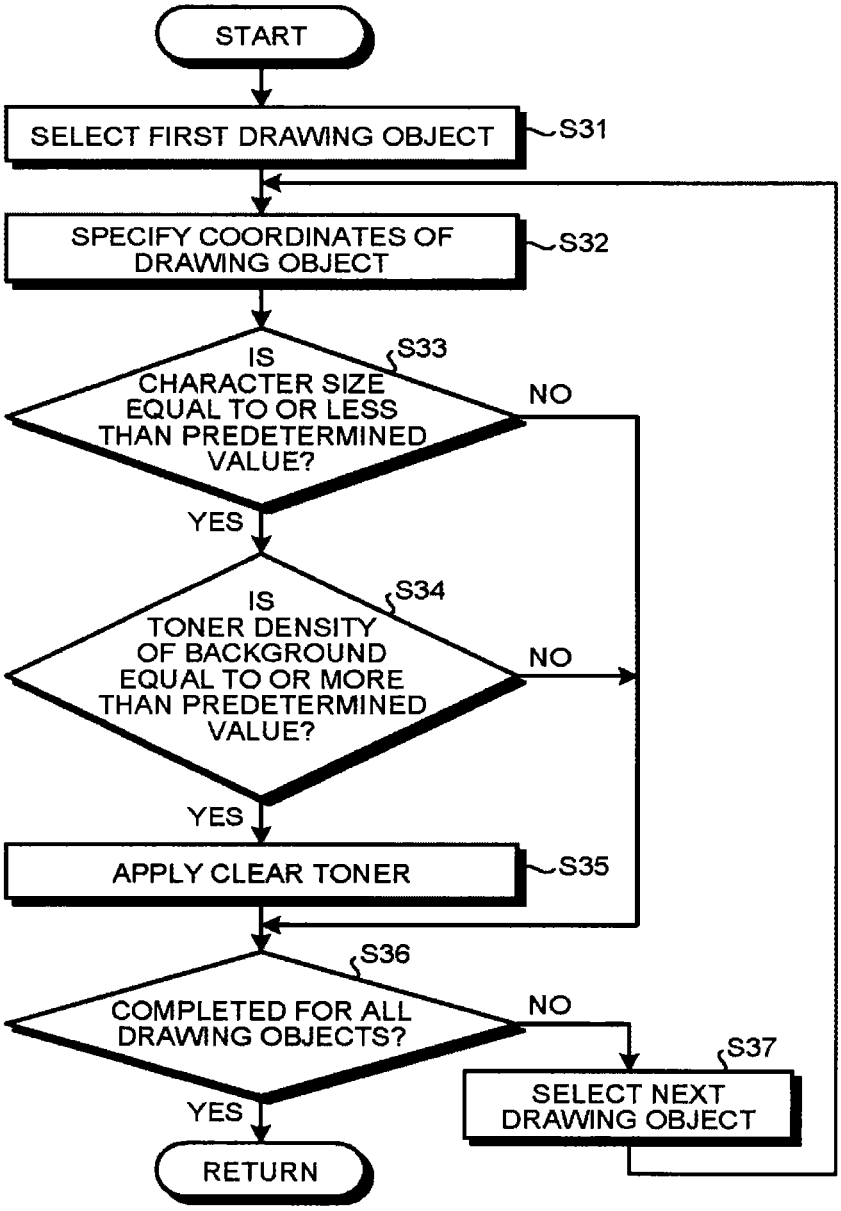
FIG. 16 is a flowchart that illustrates the steps of the operation to generate a toner-scattering prevention plane.

Next, a detailed explanation is given of an operation to generate a toner-scattering prevention plane at Step S15. FIG. 16 is a flowchart that illustrates the steps of the operation to generate a toner-scattering prevention plane.

The toner-scattering prevention plane generating unit 512 of the rendering engine 51 selects the first drawing object from the display list of the toner-scattering prevention plane (Step S31) and specifies the coordinates of the selected drawing object (Step S32).

Next, the toner-scattering prevention plane generating unit 512 determines whether the size of the selected drawing object is equal to or less than a predetermined value (Step S33). Then, if the size is equal to or less than the predetermined value (Step S33: Yes), the toner-scattering prevention plane generating unit 512 refers to each display list of CMYK to determine whether the toner density of the object (hereafter, referred to as the "background object") that is overlapped with the selected drawing object is equal to or more than a predetermined value (Step S34). If there are multiple background objects, the toner-scattering prevention plane generating unit 512 makes the above determination with respect to all of the background objects.

Then, if there is at least one background object whose toner density is equal to or more than the predetermined value (Step S34: Yes), the toner-scattering prevention plane generating unit 512 converts the selected drawing object into a raster format and represents it on the 8-bit toner-scattering prevention plane such that the toner density of the selected drawing object is 100% (Step S35).

Then, it is determined whether the above operation has been completed for all of the drawing objects that are present in the display list of the toner-scattering prevention plane (Step S36). Then, if it has not been completed for all of the drawing objects (Step S36: No), the toner-scattering prevention plane generating unit 512 selects the next drawing object, which has not been processed yet, from the display list of the toner-scattering prevention plane (Step S37), and the operation from Step S32 to Step S35 is repeated.

Conversely, at Step S36, if the operation from Step S32 to Step S35 has been completed for all of the drawing objects in the display list of the toner-scattering prevention plane (Step S36: Yes), the toner-scattering prevention plane generating unit 512 terminates the operation to generate the toner-scattering prevention plane. By the above operation, 8-bit image data is generated to prevent toner scattering with respect to a white-on-color character for which toner processing is noticeable.

Here, the size of a drawing object and the toner density of a background object, which are used as the predetermined values, may be set on the basis of the actual data that is previously measured from toner scattering.

Thus, according to the present embodiment, clear toner is applied to a white-on-color character for which the character size is small and the toner density of the background color is high; thus, it is possible to effectively prevent toner scattering. Furthermore, if an image is first formed by using clear toner in the order of toners of the printer device 70 for image formation, it is possible to prevent toner scattering more effectively.

Furthermore, according to the present embodiment, the operation to generate a toner-scattering prevention plane is always enabled; however, if disabling the operation to generate a toner-scattering prevention plane is added to the job information, the rendering engine 51 may not perform the operation to generate a toner-scattering prevention plane.

Second Embodiment

In the first embodiment, an explanation is given of a case where the toner-scattering prevention plane generating unit 512 generates toner-scattering prevention plane data to give an instruction to apply clear toner to an outline drawing. According to the present embodiment, toner-scattering prevention plane data is generated to give an instruction to apply white toner to an outline drawing filled with white (white-on-color line drawing) instead of clear toner.

Figure 17:
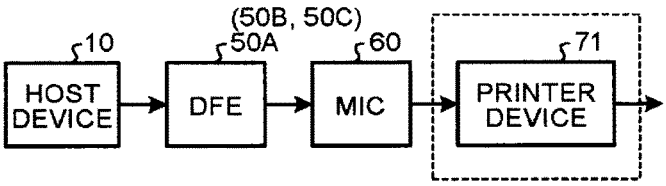
FIG. 17 is a diagram that illustrates a configuration of an image forming system according to a second embodiment.

FIG. 17 is a diagram that illustrates a configuration of an image forming system according to the present embodiment. The image forming system according to the present embodiment includes the host device 10, a DFE 50A, the MIC 60, and a printer device 71. The host device 10 and the MIC 60 are the same as those in the first embodiment.

The printer device 71 is the same as the printer device 70 according to the first embodiment except that white toner of a white color is used instead of clear toner. Specifically, the printer device 71 is a known electrophotographic image forming apparatus that forms an image by using toner of CMYK and white toner of a white color. Furthermore, the printer device 71 is configured to form an image by using white toner on the image that is formed on a recording medium by using CMYK toner.

The DFE 50A communicates with the printer device 71 via the MIC 60 and controls image formation in the printer device 71. Furthermore, the DFE 50A is connected to the host device 10. The DFE 50A receives image data (print target data) from the host device 10, uses the image data to generate image data by which the printer device 71 forms a toner image that corresponds to each toner of CMYK and white toner, and transmits it to the printer device 71 via the MIC 60. As described above, the printer device 71 has at least each toner of CMYK and white toner, and an image forming unit that includes a photosensitive element, a charge device, a developing device, and a photosensitive-element cleaner, an exposure device, and a fixing device are installed with respect to each toner. The printer device 71 forms an image on a sheet on the basis of the image data that is received via the MIC 60.

Figure 18:
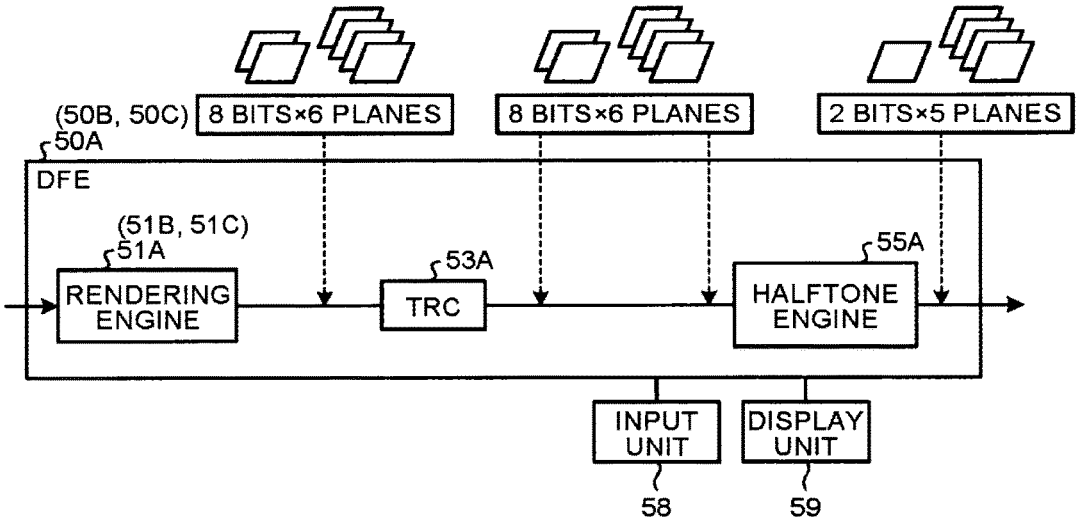
FIG. 18 is a diagram that illustrates a DFE.

FIG. 18 is a diagram that illustrates the DFE 50A. The DFE 50A includes a rendering engine 51A, a TRC 53A, and a halftone engine 55A. The rendering engine 51A, the TRC 53A, and the halftone engine 55A are implemented when a control unit of the DFE 50A executes various programs that are stored in a main storage unit or an auxiliary storage unit.

The DFE 50A is electrically connected to an input unit 58 and a display unit 59. The input unit 58 and the display unit 59 are the same as those in the first embodiment.

The rendering engine 51A receives print data (the print data illustrated in FIG. 8) that is transmitted from the host device 10 and renders the print data.

Figure 19:
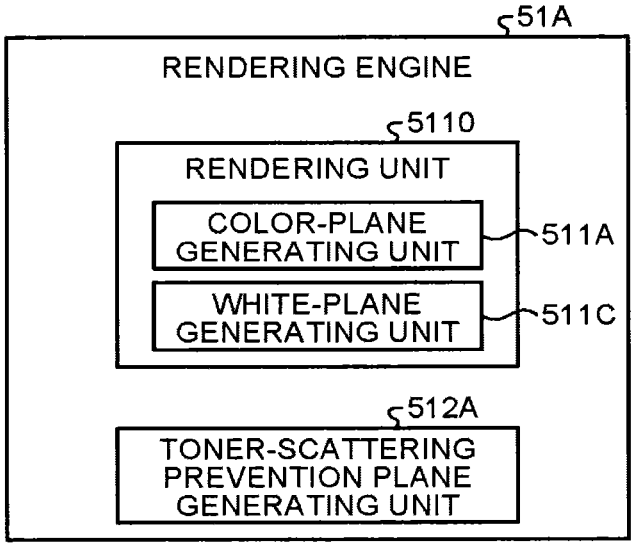
FIG. 19 is a block diagram that illustrates a functional configuration of a rendering engine.

FIG. 19 is a block diagram that illustrates a functional configuration of the rendering engine 51A. The rendering engine 51A includes a rendering unit 5110 and a toner-scattering prevention plane generating unit 512A.

The rendering unit 5110 performs language interpretation on the input print data and generates intermediate data that is called a display list and that is represented by using a vector format. Specifically, the rendering unit 5110 represents each display list of CMYKW (cyan, magenta, yellow, black, and white) in a state where the color space that is represented by using the RGB format, or the like, has been converted into the color space of the CMYK+W format.

Furthermore, the rendering unit 5110 generates a display list for each plane, i.e., each color plane of CMYK, a white plane of W, and an 8-bit toner-scattering prevention plane. Moreover, the rendering unit 5110 generates the display list of the toner-scattering prevention plane such that the drawing object that illustrates a white-on-color character is represented.

The rendering unit 5110 includes the color-plane generating unit 511A and a white-plane generating unit 511C. The color-plane generating unit 511A converts the CMYK display list into a raster format and generates each 8-bit color plane data on a CMYK color plane. The white-plane generating unit 511C converts the display list of the white plane into a raster format and generates 8-bit white plane data.

Furthermore, if the image data on a certain plane does not include valid data, the rendering unit 5110 does not output data on the corresponding plane. If image data on a certain plane is not input, each of the units that follow the rendering engine 51A, which processes image data, operates such that the image data on the plane does not include valid data.

The toner-scattering prevention plane generating unit 512A outputs 8-bit toner-scattering prevention plane image data (hereafter, referred to as the "toner-scattering prevention plane data") from the toner-scattering prevention plane display list that has been converted into a raster format. According to the present embodiment, contrary to the first embodiment, the toner-scattering prevention plane generating unit 512A generates toner-scattering prevention plane data to give an instruction to apply white toner to a white-on-color line drawing.

In the present embodiment, white toner is applied to a white-on-color character in order to prevent toner scattering that is described in the first embodiment. According to the present embodiment, the toner-scattering prevention plane data is the image data for specifying a line drawing object to which color toner is not applied and for giving an instruction to apply white toner to the object.

Figure 20:
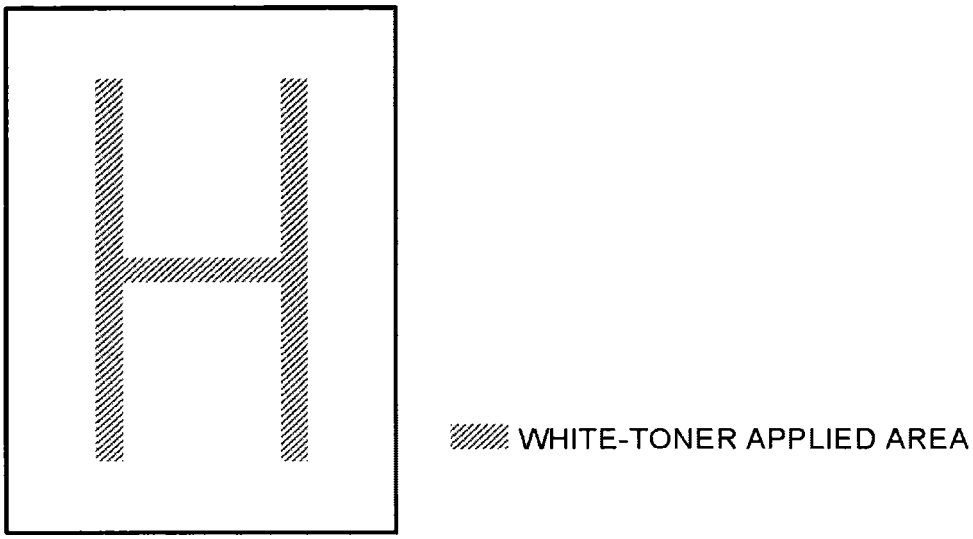
FIG. 20 is a diagram that illustrates an example of the toner-scattering prevention plane data according to the second embodiment.

FIG. 20 is a diagram that illustrates an example of the toner-scattering prevention plane data according to the present embodiment. In the toner-scattering prevention plane data, 1 pixel is represented by using 8 bits. In the present embodiment, the toner-scattering prevention plane generating unit 512A generates the toner-scattering prevention plane data such that white toner is applied to a white-on-color character if the character size is equal to or less than a predetermined value and if the toner density of the background color is equal to or more than a predetermined value.

The example of FIG. 20 illustrates that "H" is the white-toner application area that is the object to which white toner is applied. It is assumed that the density value of the applied white toner is 100%. Thus, it is possible to apply white toner for preventing toner scattering to only a character for which the effect of preventing toner scattering is high.

Furthermore, the toner-scattering prevention plane generating unit 512A may generate toner-scattering prevention plane data such that white toner is applied to all of the white-on-color characters.

Furthermore, the toner-scattering prevention plane generating unit 512A may not generate toner-scattering prevention plane data if the print data received from the host device 10 contains the information that prevents application of white toner to a white-on-color character. This information is designated by a user when the print data is generated.

Returning to FIG. 18, the TRC 53A receives each 8-bit color plane data of CMYK, 8-bit white plane data, and 8-bit toner-scattering prevention plane data. The TRC 53A performs image processing such as a gamma correction by using a gamma curve of 1D_LUT that is generated by calibration on the input 8-bit color plane data of CMYK. Furthermore, the same image processing is performed on the white plane data.

Image processing includes, in addition to the gamma correction, an adjustment on the total amount of toner, or the like. The adjustment on the total amount is the operation to restrict each 8-bit color plane data of CMYK and the white plane data, on which the gamma correction has been performed, as there is a limitation on the amount of toner that can be applied by the printer device 70 to 1 pixel on a recording medium. Furthermore, if printing is performed without the adjustment on the total amount, the image quality is degraded due to a transfer failure or a fixing failure. In the present embodiment, an explanation is given of only the related gamma correction.

The halftone engine 55A receives 8-bit color plane data of CMYK, on which the gamma correction has been performed, 8-bit white plane data, and 8-bit toner-scattering prevention plane data.

The halftone engine 55A overlaps the 8-bit toner-scattering prevention plane data with the 8-bit white plane data.

According to the present embodiment, after image processing is performed to adjust the total amount, toner-scattering prevention plane data is overlapped with white plane data; therefore, it sometimes exceeds the total-amount adjustment value. However, it is assumed that, as a white-on-color character on the toner-scattering prevention plane data is small, the effect on the total amount of toner is ignorable. If it is not ignorable, image processing may be performed with a lower total-amount adjustment value than the original total-amount adjustment value such that the total-amount adjustment value is not exceeded if toner-scattering prevention plane data is overlapped with white plane data.

Next, the halftone engine 55A performs halftone processing on the input color plane data and the data that is obtained by overlapping the toner-scattering prevention plane data and the white plane data so as to convert them into a data format for output to the printer device 71. The halftone processing is the same as that in the first embodiment. Then, the halftone engine 55A integrates the color plane data, on which the halftone processing has been performed, with the data that is obtained by overlapping the toner-scattering prevention plane data and the white plane data and outputs the integrated image data to the MIC 60.

Figure 21:
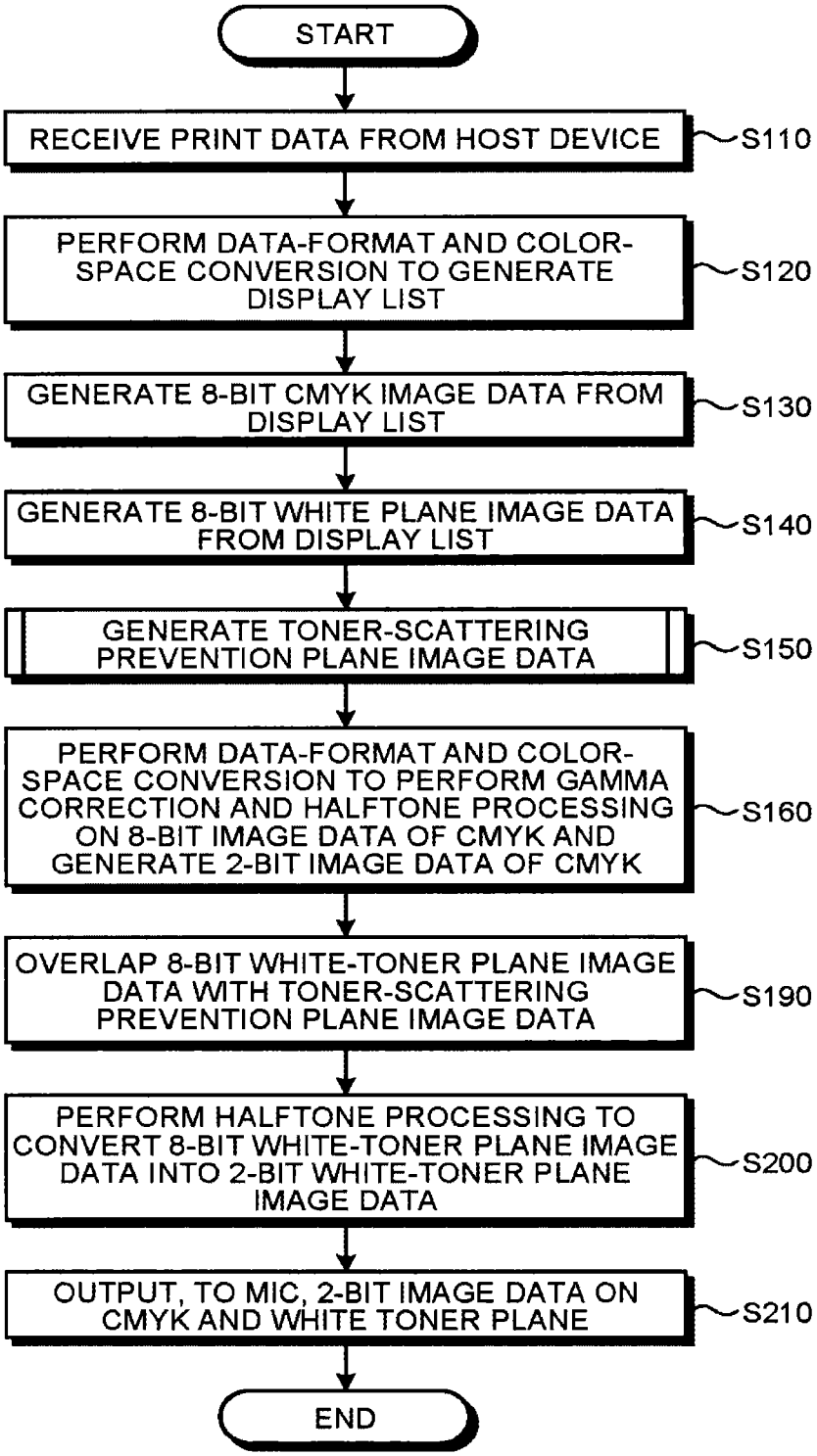
FIG. 21 is a flowchart that illustrates the steps of image processing that is performed by the image forming system according to the second embodiment.

FIG. 21 is a flowchart that illustrates the steps of image processing that is performed by the image forming system according to the present embodiment. First, after the DFE 50A receives print data from the host device 10 (Step S110), the rendering unit 5110 of the rendering engine 51A performs language interpretation on it and performs data-format and color-space conversion so as to generate a display list (Step S120).

Next, the color-plane generating unit 511A of the rendering unit 5110 converts each display list of CMYK into a raster format and generates 8-bit CMYK color plane data (Step S130). Then, the white-plane generating unit 511C of the rendering unit 5110 converts the display list of the white plane data into a raster format and generates 8-bit white plane data (Step S140).

Next, the toner-scattering prevention plane generating unit 512A generates 8-bit toner-scattering prevention plane data (Step S150). A detailed explanation is given later of an operation to generate the toner-scattering prevention plane data.

Next, after the operation to generate the toner-scattering prevention plane data is completed, the TRC 53A performs a gamma correction on each 8-bit color plane data and white plane data of CMYK and white by using a gamma curve of 1D_LUT that is generated by calibration and outputs, to the halftone engine 55A, each 8-bit color plane data and white plane data of CMYK and white, on which the gamma correction has been performed, and the image data on the 8-bit toner-scattering prevention plane. The halftone engine 55A performs halftone processing on the above data, on which the gamma correction has been performed, to convert it into the data format of each 2-bit color plane data of CMYK for output to the printer device 71 and obtains each 2-bit color plane data of CMYK on which the halftone processing has been performed (Step S160).

Next, the halftone engine 55A overlaps the 8-bit white plane data with the 8-bit toner-scattering prevention plane data (Step S190).

Next, the halftone engine 55A performs halftone processing to convert the 8-bit data, which is overlapped at Step S190, into 2-bit white plane data (Step S200).

Furthermore, the halftone engine 55A integrates each 2-bit color plane data of CMYK, which is obtained at Step S160 and on which the halftone processing has been performed, with the 2-bit white plane data, which is generated at Step S200, and outputs the integrated image data to the MIC 60 (Step S210). Then, this routine is terminated.

Figure 22:
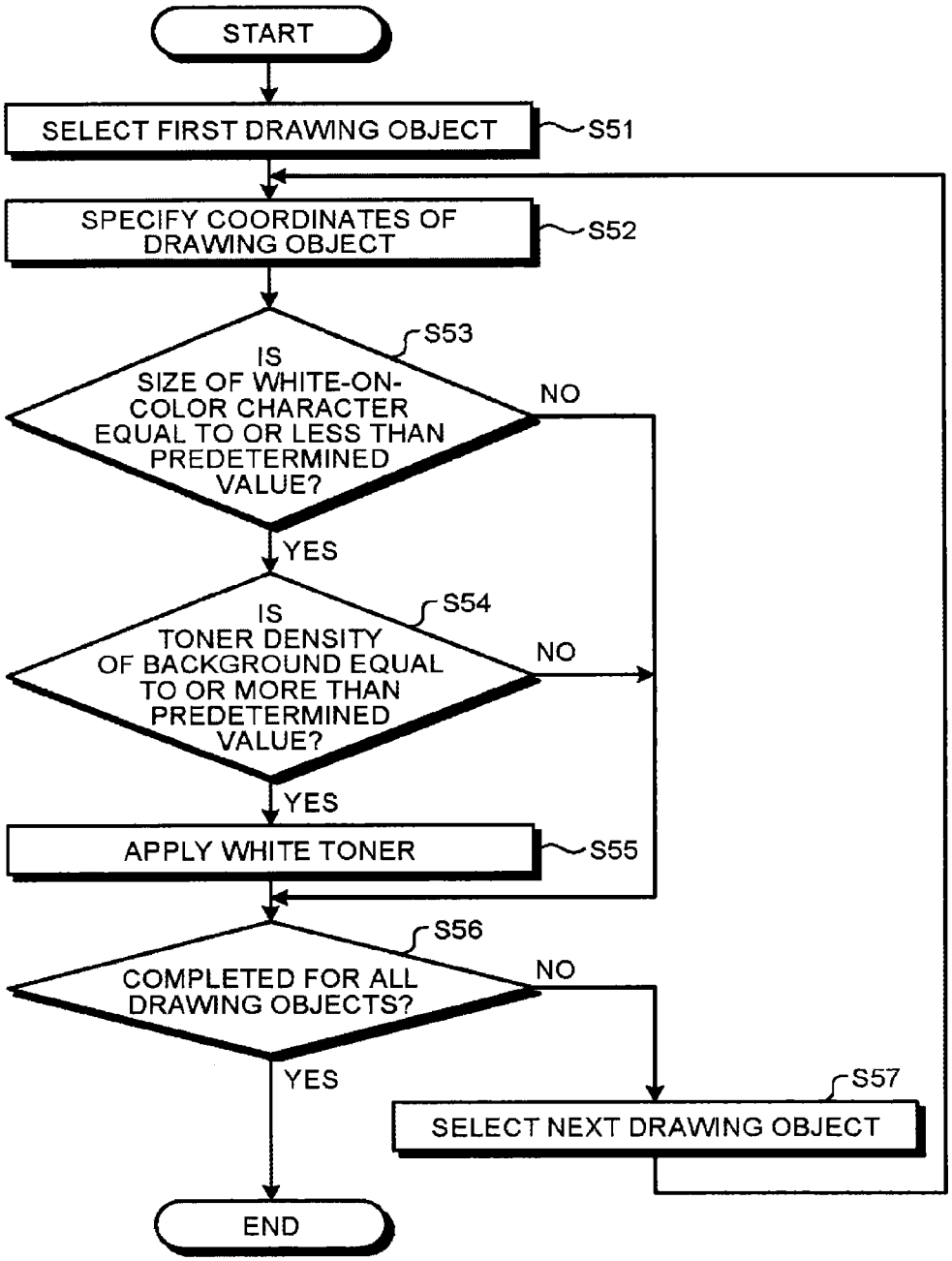
FIG. 22 is a flowchart that illustrates the steps of the operation to generate a toner-scattering prevention plane.

Next, a detailed explanation is given of an operation to generate a toner-scattering prevention plane at Step S150. FIG. 22 is a flowchart that illustrates the steps of the operation to generate a toner-scattering prevention plane at Step S150.

First, the toner-scattering prevention plane generating unit 512A selects a first drawing object from the display list of the toner-scattering prevention plane (Step S51) and specifies the coordinates of the selected drawing object (Step S52).

Next, the toner-scattering prevention plane generating unit 512A determines whether the size of the selected drawing object is equal to or less than a predetermined value (Step S53). Specifically, in accordance with a determination at Step S53, the toner-scattering prevention plane generating unit 512A determines whether the size of a white-on-color character that is the drawing object indicated by the toner-scattering prevention plane is equal to or less than a predetermined value.

Then, if the size is equal to or less than the predetermined value (Step S53: Yes), the toner-scattering prevention plane generating unit 512A refers to each display list of CMYK to determine whether the toner density of the object (hereafter, referred to as the "background object") that is overlapped with the selected drawing object is equal to or more than a predetermined value (Step S54). If there are multiple background objects, the toner-scattering prevention plane generating unit 512A makes the above determination on all of the background objects.

Then, if there is at least one background object whose toner density is equal to or more than the predetermined value (Step S54: Yes), the toner-scattering prevention plane generating unit 512A converts the selected drawing object into a raster format and represents it on the 8-bit toner-scattering prevention plane such that the toner density of the selected drawing object is 100% (Step S55). Thus, an instruction is given to apply white toner to a white-on-color line drawing.

Next, the toner-scattering prevention plane generating unit 512A determines whether the operation from Step S52 to Step S55 has been completed for all of the drawing objects that are present in the display list of the toner-scattering prevention plane (Step S56). Then, if it has not been completed for all of the drawing objects (Step S56: No), the toner-scattering prevention plane generating unit 512A selects the next drawing object, which has not been processed yet, from the display list of the toner-scattering prevention plane (Step S57), and the operation from Step S52 to Step S55 is repeated.

Conversely, at Step S56, if the operation from Step S52 to Step S55 has been completed for all of the drawing objects in the display list of the toner-scattering prevention plane (Step S56: Yes), the toner-scattering prevention plane generating unit 512A terminates the operation to generate the toner-scattering prevention plane. By the above operation, toner-scattering prevention plane data is generated to given an instruction to apply white toner to a white-on-color line drawing.

Furthermore, the size (Step S53) of a drawing object and the toner density (Step S54) of a background object, which are used as the predetermined values, may be set on the basis of the actual data that is previously measured from toner scattering.

As described above, in the present embodiment, the toner-scattering prevention plane generating unit 512A generates toner-scattering prevention plane data to give an instruction to apply white toner to a white-on-color line drawing. Thus, an image is formed on the area that corresponds to a white-on-color line drawing by using white toner.

Therefore, in the present embodiment, it is possible to prevent toner scattering on a white-on-color line drawing.

Furthermore, according to the present embodiment, white toner can be applied to a white-on-color character whose character size is small and the toner density of the background color is high. Therefore, according to the present embodiment, it is possible to effectively prevent toner scattering.

According to the present embodiment, the operation to generate a toner-scattering prevention plane is always enabled; however, if disabling the operation to generate a toner-scattering prevention plane is added to the job information, the rendering engine 51 may not perform the operation to generate a toner-scattering prevention plane. Furthermore, if the job information contains the information that enables the operation to generate a toner-scattering prevention plane, the toner-scattering prevention plane generating unit 512A may generate toner-scattering prevention plane data.

Third Embodiment

When the toner-scattering prevention plane generating unit 512A according to the present embodiment generates 8-bit toner-scattering prevention plane data from the display list of a toner-scattering prevention plane, it generates a toner-scattering prevention plane that includes, as a white-on-color character (drawing object), an expanded white-on-color character that is obtained by expanding a white-on-color character by a predetermined dot value. Furthermore, the configuration and the operation according to the present embodiment are the same as those in the second embodiment except that the toner-scattering prevention plane generating unit 512A generates a toner-scattering prevention plane that includes an expanded white-on-color character as the above-described white-on-color character (drawing object).

Figure 23:
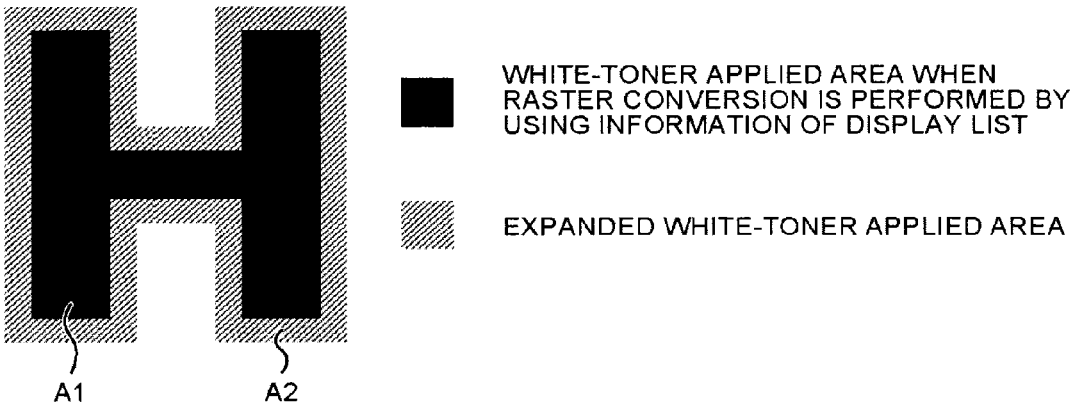
FIG. 23 is an explanatory diagram of a white-on-color character that is generated by a toner-scattering prevention plane generating unit.

FIG. 23 is an explanatory diagram of a white-on-color character that is generated by the toner-scattering prevention plane generating unit 512A according to the present embodiment. As illustrated in FIG. 23, an area A1 is the white-toner applied area that corresponds to the white-on-color character in the 8-bit toner-scattering prevention plane data that is generated from the display list of the toner-scattering prevention plane. The area A1 is the area that corresponds to the white-on-color character that is specified by the print target data. An area A2 represents the expanded area that is obtained by expanding the white-on-color character by a predetermined dot value.

As illustrated in FIG. 23, according to the present embodiment, the toner-scattering prevention plane generating unit 512A generates toner-scattering prevention plane data that includes, as a white-on-color character, the expanded white-on-color character (the section of the area A1 and the area A2) that is obtained by expanding the area A1 of the white-on-color character that is specified by the display list of the toner-scattering prevention plane by a predetermined dot value.

Therefore, the white-on-color character that is formed by the printer device 71 by using white toner on the basis of the toner-scattering prevention plane data is the character that is obtained by widening (expanding) the white-on-color character that is specified by the print target data.

Furthermore, the toner density of the white toner on the area (the section of the area A1 and the area A2) of an expanded white-on-color character according to the present embodiment is 100%. Moreover, the dot value (the area A2) for expanding a white-on-color character may be set on the basis of the actual data that is previously measured from plane misalignment.

Here, with regard to the area A1 of the white-on-color character that is specified by the display list of the toner-scattering prevention plane, there is a possibility that the legibility of the white-on-color character is degraded due to a gap that is generated between the area of the color image that is formed on the basis of the 2-bit color plane data of CMYK and the white area that is formed on the basis of the 2-bit white plane data due to a plane misalignment, or the like, during an image formation in the printer device 71.

Furthermore, according to the present embodiment, the toner-scattering prevention plane generating unit 512A generates toner-scattering prevention plane data that includes, as a white-on-color character, the expanded white-on-color character (the section of the area A1 and the area A2) that is obtained by expanding the area A1 of the white-on-color character that is specified by the display list of the toner-scattering prevention plane by a predetermined dot value.

As described above, a white-on-color character is expanded according to the present embodiment; therefore, it is possible to prevent a gap that is generated between the area of a color image and the white area that is formed on the basis of 2-bit white plane data. Thus, according to the present embodiment, in addition to the advantage of the above-described embodiment, it is possible to prevent a degradation of the legibility of white-on-color characters.

Fourth Embodiment

According to the present embodiment, while a trapping operation is enabled, the trapping operation is disabled for the area that corresponds to a white-on-color character in the color image that is specified by CMYK color plane data.

FIG. 17 is a diagram that illustrates a configuration of an image forming system according to the present embodiment. The image forming system according to the present embodiment includes the host device 10, a DFE 50B, the MIC 60, and the printer device 71. The host device 10, the MIC 60, and the printer device 71 are the same as those in the second embodiment.

The DFE 50B communicates with the printer device 71 via the MIC 60 and controls image formation in the printer device 71. Furthermore, the DFE 50B is connected to the host device 10. The DFE 50B receives image data (print target data) from the host device 10, uses the image data to generate image data by which the printer device 71 forms a toner image that corresponds to each toner of CMYK and white toner, and transmits it to the printer device 71 via the MIC 60.

FIG. 18 is a diagram that illustrates the DFE 50B. The DFE 50B includes a rendering engine 51B, the TRC 53A, and the halftone engine 55A. The rendering engine 51B, the TRC 53A, and the halftone engine 55A are implemented when a control unit of the DFE 50B executes various programs that are stored in a main storage unit or an auxiliary storage unit. The DFE 50B is electrically connected to the input unit 58 and the display unit 59. The DFE 50B is the same as that in the second embodiment except that it includes the rendering engine 51B instead of the rendering engine 51A.

The rendering engine 51B receives print data (the print data illustrated in FIG. 8) that is transmitted from the host device 10 and renders the print data.

Figure 24:
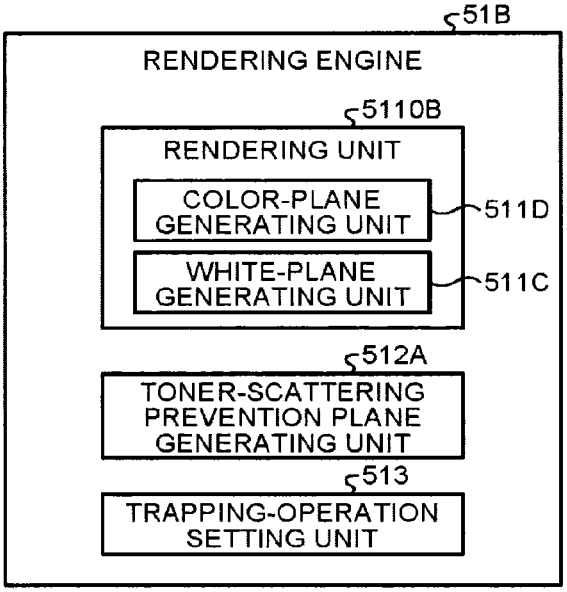
FIG. 24 is a block diagram that illustrates a functional configuration of a rendering engine.

FIG. 24 is a block diagram that illustrates a functional configuration of the rendering engine 51B. The rendering engine 51B includes a rendering unit 5110B, the toner-scattering prevention plane generating unit 512A, and a trapping-operation setting unit 513. The toner-scattering prevention plane generating unit 512A is the same as that in the second embodiment.

The rendering unit 5110B includes a color-plane generating unit 511D and the white-plane generating unit 511C. The white-plane generating unit 511C is the same as that in the second embodiment. The color-plane generating unit 511D will be explained later.

The trapping-operation setting unit 513 receives an instruction for a trapping operation. According to the present embodiment, the trapping-operation setting unit 513 receives an instruction for the trapping operation that is input when a user operates the input unit 58 for an instruction. When the trapping-operation setting unit 513 receives an instruction for the trapping operation, it sets the enabling information that indicates that the trapping operation is enabled.

Furthermore, when the trapping-operation setting unit 513 receives canceling of the trapping operation, it sets the disabling information that indicates that the trapping operation is disabled. The trapping-operation setting unit 513 stores the enabling information or the disabling information in an undepicted storage unit for settings.

The trapping operation is the operation to form, in the boundary of a drawing object that is included in the print target data, an expanded area that is obtained by expanding the drawing object. By the trapping operation, it is possible to prevent a gap that is formed between drawing objects due to, for example, a color shift of YMCK color planes.

Figure 25:
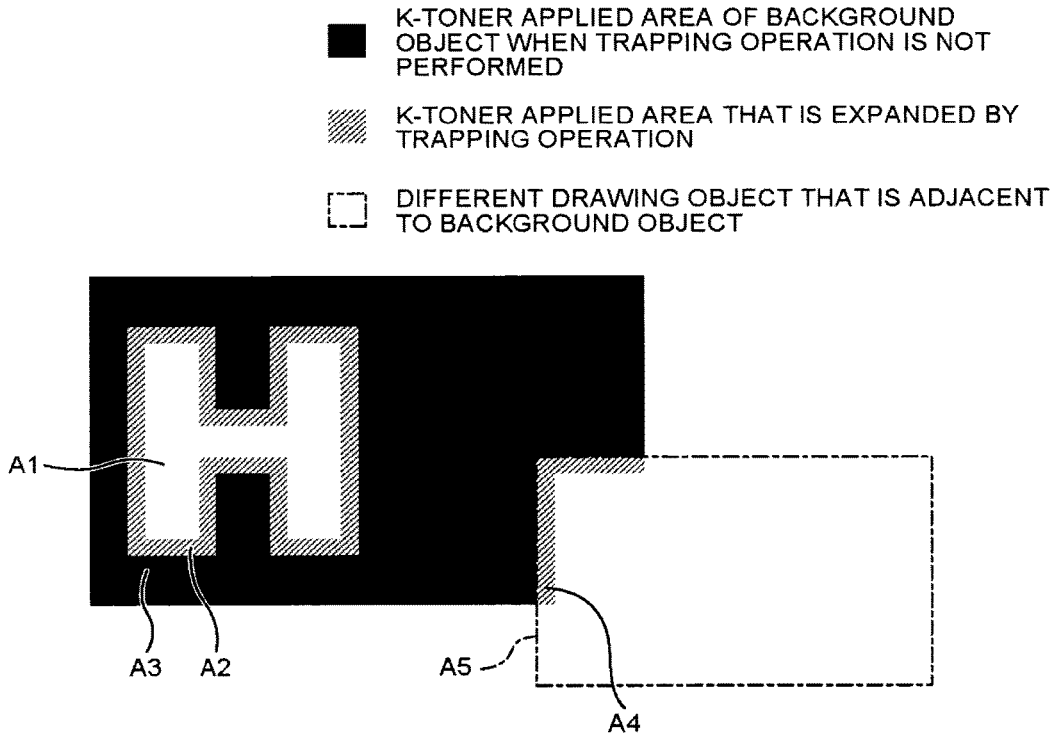
FIG. 25 is an explanatory diagram of a trapping operation.

FIG. 25 is an explanatory diagram of the trapping operation. It is assumed that the print target data contains a background object A3 that is the black color area that includes the white-on-color character that represents "H" and contains a rectangular object A5 that is adjacent to the background object.

In this case, during the trapping operation, the area to which black toner is applied is expanded from the black background object A3 toward a boundary area A4 between the background object A3 and the rectangular object A5 that is adjacent to the background object.

However, the black background object A3, which is the color area, sometimes includes a white-on-color character that is the area to which color toner is not applied. In this case, during the trapping operation, there is a possibility that the area A1 of the white-on-color character is crushed by the toner of the background object A3 and the legibility of the white-on-color character is decreased. For example, there is a possibility that the area of the black background object A3 is expanded toward the area A1 of the white-on-color character and the area of the background object A3 is crushed by the black toner on the expanded area A2.

Returning to FIG. 24, therefore, according to the present embodiment, if the trapping-operation setting unit 513 sets the enabling information that indicates the trapping operation is enabled, the color-plane generating unit 511D disables the trapping operation for the area that corresponds to the white-on-color character with respect to the drawing object that includes the white-on-color character. Thus, a decrease in the legibility can be prevented.

Figure 26:
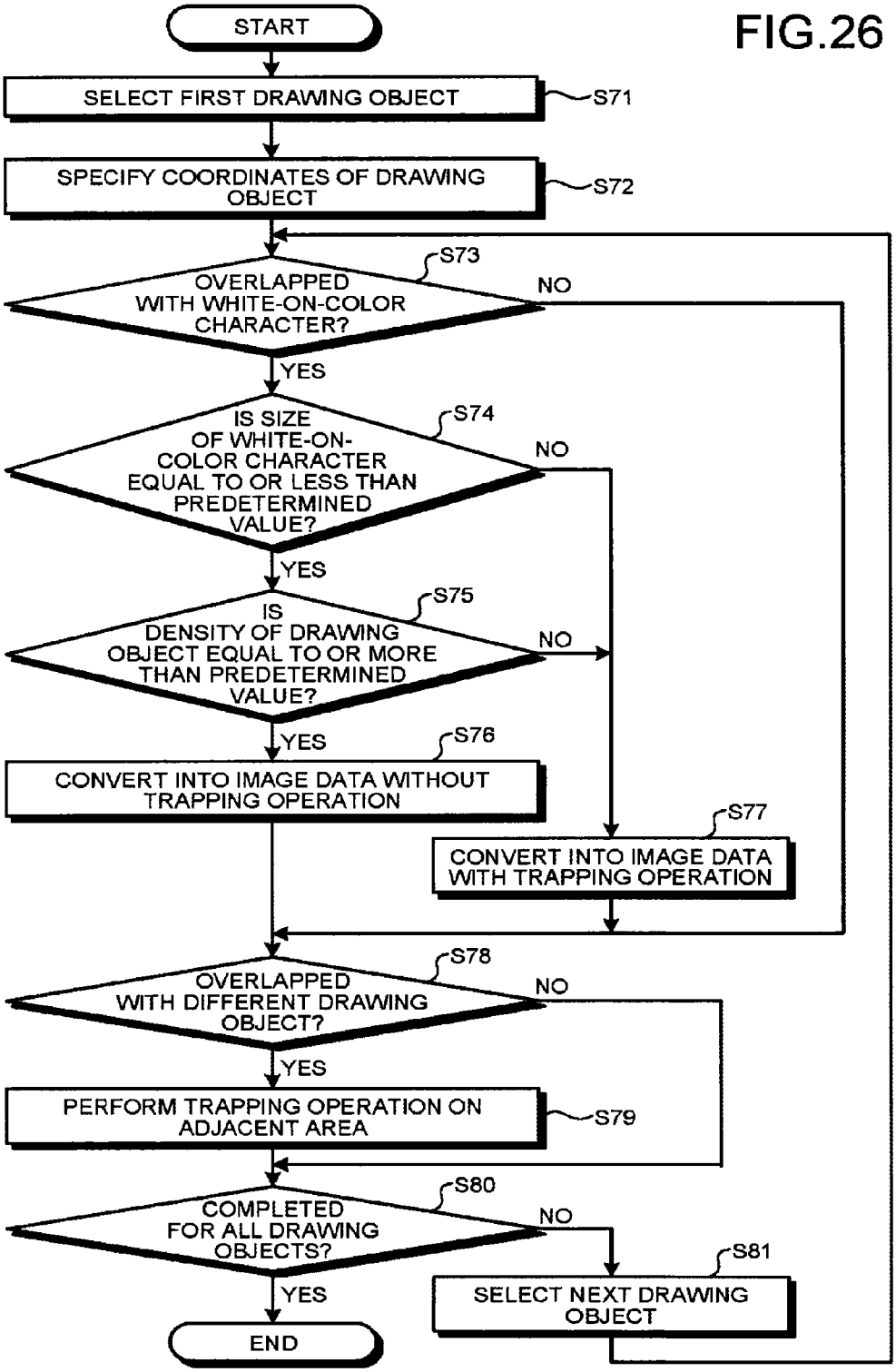
FIG. 26 is an explanatory diagram of an operation performed by a color-plane generating unit to generate color plane data.

FIG. 26 is an explanatory diagram of an operation performed by the color-plane generating unit 511D to generate color plane data when the trapping-operation setting unit 513 sets the enabling information. Furthermore, the color-plane generating unit 511D performs the steps on the display list of each color plane of CMYK. In the following explanation, the color plane data of C color is given as an example.

The color-plane generating unit 511D selects the first drawing object from the display list of C color (Step S71) and specifies the coordinates of the selected drawing object (Step S72).

Next, the color-plane generating unit 511D refers to the display list of the toner-scattering prevention plane and determines whether the white-on-color character is overlapped with the selected drawing object (Step S73). If they are not overlapped (Step S73: No), the operation of Step S78 is subsequently performed. If they are overlapped (Step S73: Yes), the color-plane generating unit 511D determines whether the size of the white-on-color character is equal to or less than a predetermined value (Step S74). Furthermore, if the size is equal to or less than the predetermined value (Step S74: Yes), the color-plane generating unit 511D refers to each display list of CMYK and determines whether the toner density of the selected drawing object is equal to or more than a predetermined value (Step S75). Then, if the toner density of the selected drawing object is equal to or more than the predetermined value (Step S75: Yes), the process proceeds to Step S76.

At Step S76, the color-plane generating unit 511D represents the selected drawing object on the 8-bit color plane data of C color such that the trapping operation is not applied to the boundary of the white-on-color character (Step S76).

If it is negative at Step S74 (Step S74: No) or if it is negative at Step S75 (Step S75: No), the color-plane generating unit 511D applies the trapping operation to the boundary of the white-on-color character and represents the selected drawing object, which has been converted from the vector format into the raster format, on the 8-bit color plane data of C color (Step S77).

Furthermore, if multiple white-on-color characters are overlapped with the drawing object that is selected at Step S71, the color-plane generating unit 511D performs the above operation on each of them. Furthermore, if a white-on-color character is overlapped with part of the object that is selected at Step S71, the above operation is performed on only the boundary area.

Next, the color-plane generating unit 511D refers to the display list of CMYK and determines whether a different object is overlapped with the drawing object that is selected at Step S71 (Step S78). If it is not overlapped (Step S78: No), the operation of Step S80 is performed. If it is overlapped (Step S78: Yes), the color-plane generating unit 511D specifies the area that is adjacent to the overlapping object, performs the trapping operation on the area, and represents the selected drawing object on the 8-bit color plane data of C color (Step S79).

If multiple different objects are overlapped with the drawing object that is selected at Step S71, the color-plane generating unit 511D performs the above operation on each of them. Then, the color-plane generating unit 511D determines whether the above operation has been completed for all of the drawing objects that are present in the display list of C color (Step S80). Then, if it has not been completed for all of the drawing objects (Step S80: No), the color-plane generating unit 511D selects the next drawing object, which has not been processed yet, from the display list of C color (Step S81) and repeats the operation from Step S73 to Step S79.

Conversely, at Step S80, if the operation from Step S73 to Step S79 has been completed for all of the drawing objects in the display list of C color (Step S80: Yes), the color-plane generating unit 511D terminates the operation to generate color plane data of C color. The above operation is also performed on MYK; thus, even if the trapping operation is enabled, 8-bit color plane data is generated without the trapping operation performed on the boundary between a white-on-color character and a background object.

Furthermore, the size of a white-on-color character, the toner density of a drawing object that is overlapped with a white-on-color character, and the number of dots for expansion during a trapping operation, which are used as predetermined values, may be set on the basis of the actual data that is previously measured from a plane misalignment.

As described above, according to the present embodiment, when a trapping operation is enabled, the trapping operation is disabled for the area that corresponds to a white-on-color character in CMYK color plane data. Therefore, according to the present embodiment, in addition to the advantage of the above-described embodiment, a decrease in the legibility of white-on-color characters can be prevented.

Fifth Embodiment

According to the present embodiment, color toner of at least one of CMYK is applied to the area that corresponds to a white-on-color character in CMYK color plane data.

FIG. 17 is a diagram that illustrates a configuration of an image forming system according to the present embodiment. The image forming system according to the present embodiment includes the host device 10, a DFE 50C, the MIC 60, and the printer device 71. The host device 10, the MIC 60, and the printer device 71 are the same as those in the second embodiment.

The DFE 50C communicates with the printer device 71 via the MIC 60 and controls image formation in the printer device 71. Furthermore, the DFE 50C is connected to the host device 10. The DFE 50C receives image data (print target data) from the host device 10, uses the image data to generate image data by which the printer device 71 forms a toner image that corresponds to each toner of CMYK and white toner, and transmits it to the printer device 71 via the MIC 60.

FIG. 18 is a diagram that illustrates the DFE 50C. The DFE 50C includes a rendering engine 51C, the TRC 53A, and the halftone engine 55A. The rendering engine 51C, the TRC 53A, and the halftone engine 55A are implemented when a control unit of the DFE 50C executes various programs that are stored in a main storage unit or an auxiliary storage unit. The DFE 50C is electrically connected to the input unit 58 and the display unit 59. The DFE 50C is the same as that in the second embodiment except that it includes the rendering engine 51C instead of the rendering engine 51A.

The rendering engine 51C receives print data (the print data illustrated in FIG. 8) that is transmitted from the host device 10 and renders the print data.

Figure 27:
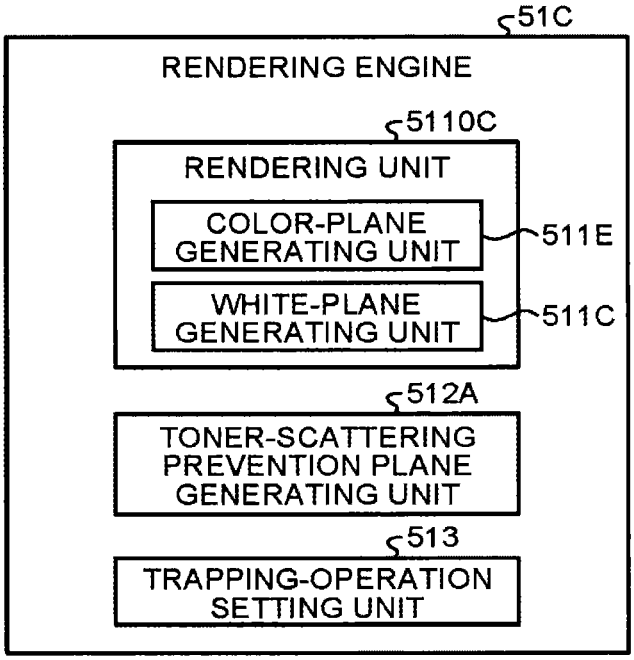
FIG. 27 is a block diagram that illustrates a functional configuration of a rendering engine.

FIG. 27 is a block diagram that illustrates a functional configuration of the rendering engine 51C. The rendering engine 51C includes a rendering unit 5110C, the toner-scattering prevention plane generating unit 512A, and the trapping-operation setting unit 513. The toner-scattering prevention plane generating unit 512A and the trapping-operation setting unit 513 are the same as those in the fourth embodiment.

The rendering unit 5110C includes a color-plane generating unit 511E and the white-plane generating unit 511C. The white-plane generating unit 511C is the same as that in the second embodiment. The color-plane generating unit 511E will be explained later.

The color-plane generating unit 511E converts the display list of CMYK into a raster format and generates each 8-bit color plane data on CMYK color planes. Furthermore, according to the present embodiment, the color-plane generating unit 511E generates the 8-bit color plane data such that toner of at least one of CMYK colors is applied to the area of a white-on-color character. Specifically, according to the present embodiment, the color-plane generating unit 511E generates color plane data to give an instruction to apply color toner to the area that corresponds to a color image and the area that corresponds to a white-on-color character.

Figure 28:
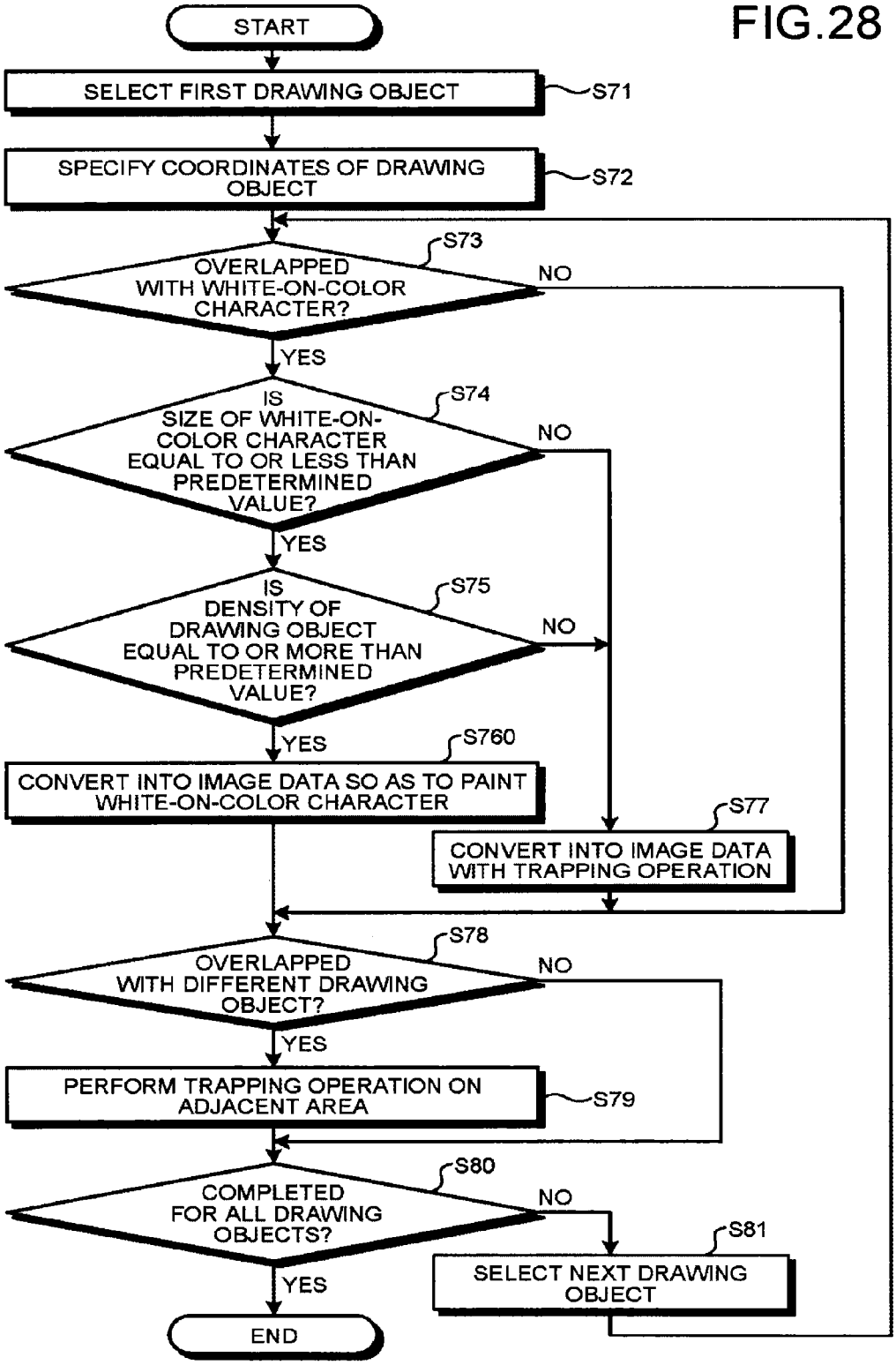
FIG. 28 is an explanatory diagram of an operation performed by a color-plane generating unit to generate color plane data.

FIG. 28 is an explanatory diagram of an operation performed by the color-plane generating unit 511E to generate color plane data when the trapping-operation setting unit 513 sets the enabling information. Furthermore, the color-plane generating unit 511E performs the steps on the display list of each color plane of CMYK. In the following explanation, the color plane of C color is given as an example.

The color-plane generating unit 511E performs the operation from Step S71 to Step S81 that are illustrated with reference to FIG. 26 in the fourth embodiment. However, the color-plane generating unit 511E performs the operation of Step S760 instead of the operation of Step S76 in FIG. 26.

At Step S760, in order to paint the white-on-color character that is the white-on-color area included in the drawing object that is previously selected at Step S71 or Step S81, the color-plane generating unit 511E represents the selected object on the 8-bit C color plane data.

By the operation at Step S760, CMYK color plane data is generated such that the area of the white-on-color character included in the color drawing object is painted with color (CMYK) toner.

As described above, according to the present embodiment, 8-bit color plane data is generated such that the area of a white-on-color character in the CMYK color plane data is painted with color toner.

Here, as described in the second embodiment, the printer device 71 is configured to form an image by using white toner on the image that is formed on a recording medium by using CMYK toner. Therefore, the color toner on the basis of the color plane data and the white toner on the basis of the toner-scattering prevention plane data are formed on the area of a white-on-color character that is formed on a recording medium in an overlapped manner in this order.

Therefore, according to the present embodiment, in addition to the advantage of the above-described embodiment, a decrease in the legibility of white-on-color characters can be prevented.

Furthermore, according to the present embodiment, CMYK color plane data is generated such that the area of a white-on-color character included in a color drawing object is painted with color (CMYK) toner. Thus, according to the present embodiment, in addition to the above-described advantage, it is possible to prevent the effect of a plane misalignment of a color plane and a white plane.

Sixth Embodiment

According to the first embodiment, a configuration is such that the clear processing 56 is provided in the DFE 50 and the DFE 50 performs the operation to determine the surface-effect selection table and the operation to generate clear-toner plane data; however, this is not a limitation.

Specifically, a configuration may be such that any of the operations that are performed by one device is performed by one or more different devices that are connected to the device via a network.

For example, in the image forming system according to the sixth embodiment, a part of the functions of the DFE is implemented by a server device on a network.

Figure 29:
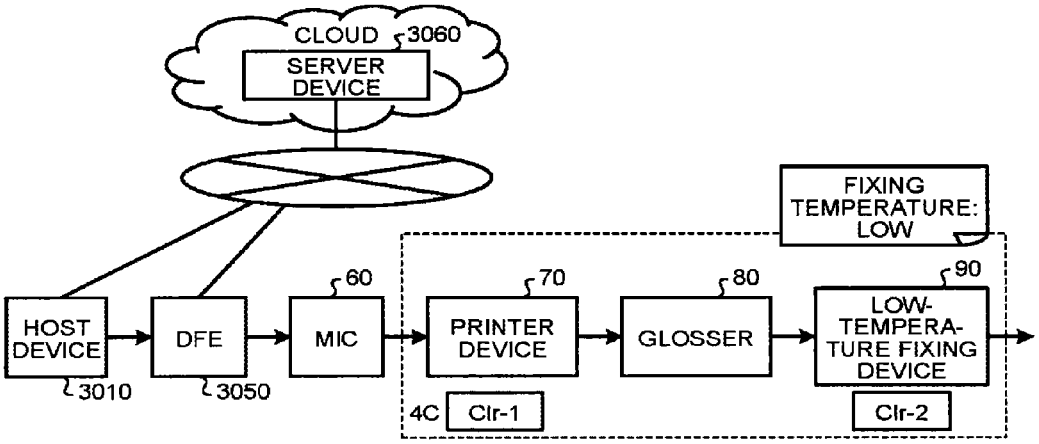
FIG. 29 is a diagram that illustrates a configuration of an image forming system.

FIG. 29 is a diagram that illustrates a configuration of the image forming system according to the sixth embodiment. As illustrated in FIG. 29, the image forming system according to the present embodiment includes a host device 3010, a DFE 3050, the MIC 60, the printer device 70, the glosser 80, the low-temperature fixing device 90, and a server device 3060 on a cloud. There is no limitation on post handling devices, such as the glosser 80 or the low-temperature fixing device 90.

According to the present embodiment, the host device 3010 and the DFE 3050 are configured to connect to the server device 3060 via a network, such as the Internet. Furthermore, according to the present embodiment, a configuration is such that the server device 3060 is provided with the module for performing an operation to generate each plane data of the host device 10 according to the first embodiment and with the clear processing 56 of the DFE 50 according to the first embodiment.

Here, the connection configuration of the host device 3010, the DFE 3050, the MIC 60, the printer device 70, the glosser 80, and the low-temperature fixing device 90 is the same as that in the first embodiment.

Specifically, according to the sixth embodiment, a configuration is such that the host device 3010 and the DFE 3050 are connected to the single server device 3060 via a network (cloud), such as the Internet, the server device 3060 is provided with a plane-data generating unit 3062, a print-data generating unit 3063, a toner-scattering prevention plane generating unit 3067, and a clear processing 3066, and the server device 3060 performs a plane-data generation operation to generate color plane data, clear plane data, and gloss-control plane data, the operation to generate print data, the operation to generate toner-scattering prevention plane data, and the operation to generate clear-toner plane data.

Figure 30:
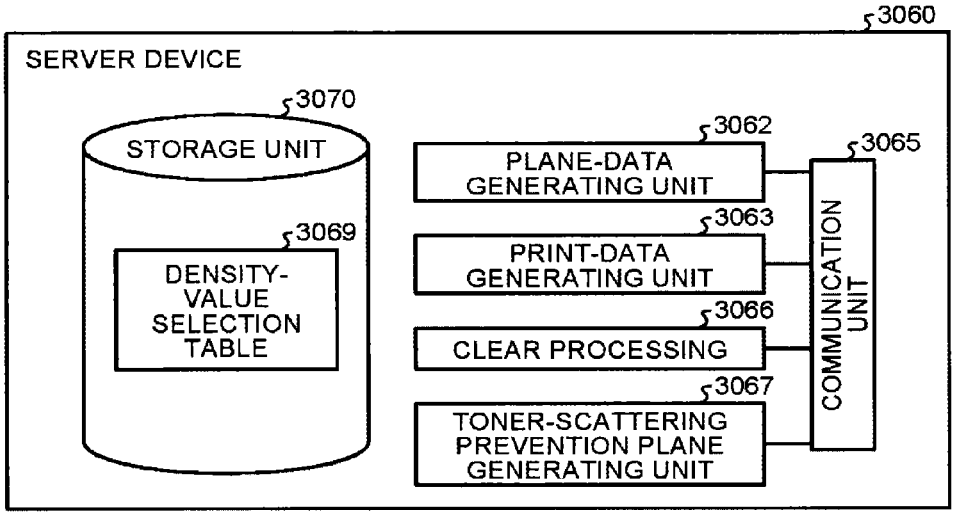
FIG. 30 is a block diagram that illustrates a functional configuration of a server device.

First, an explanation is given of the server device 3060. FIG. 30 is a block diagram that illustrates a functional configuration of the server device 3060 according to the sixth embodiment. The server device 3060 principally includes a storage unit 3070, the plane-data generating unit 3062, the print-data generating unit 3063, the toner-scattering prevention plane generating unit 3067, the clear processing 3066, and a communication unit 3065.

The storage unit 3070 is a storage medium, such as an HDD or a memory, and it stores a density-value selection table 3069.

The communication unit 3065 transmits and receives various types of data and requests to and from the host device 3010 and the DFE 3050. More specifically, the communication unit 3065 receives, from the host device 3010, image designation information, designation information, and a request to generate print data and transmits the generated print data to the host device 3010. Furthermore, the communication unit 3065 receives, from the DFE 3050, 8-bit gloss control plane image data, 8-bit color plane image data, and a request to generate a clear toner plane and transmits the generated clear-toner plane image data and the on/off information to the DFE 3050.

The plane-data generating unit 3062 generates color plane data, gloss-control plane data, and clear plane data in the same manner as the host device 10 according to the first embodiment.

The print-data generating unit 3063 according to the present embodiment generates the print data illustrated in FIG. 8 in the same manner as the host device 10 according to the first embodiment.

The toner-scattering prevention plane generating unit 3067 has the same functionality as the toner-scattering prevention plane generating unit 512 of the rendering engine 51 of the DFE 50 according to the first embodiment.

The clear processing 3066 has the same functionality as the clear processing 56 of the DFE 50 according to the first embodiment.

Figure 31:
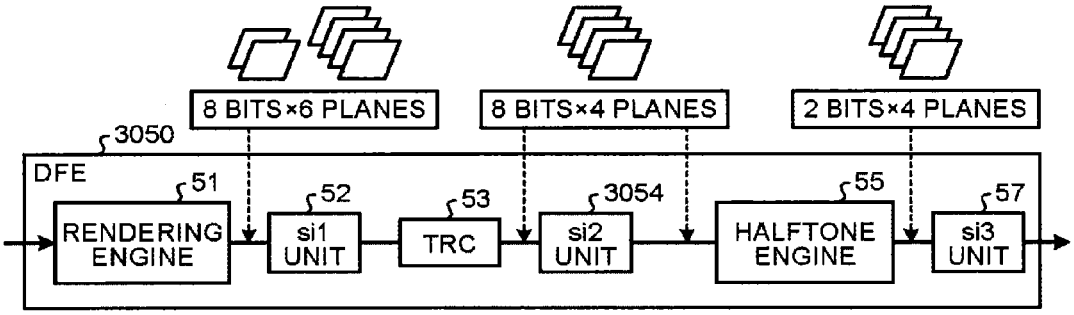
FIG. 31 is a block diagram that illustrates a functional configuration of a DFE.

Next, an explanation is given of the DFE 3050. FIG. 31 is a block diagram that illustrates a functional configuration of the DFE 3050 according to the present embodiment. The DFE 3050 according to the present embodiment principally includes the rendering engine 51, the si1 unit 52, the TRC 53, an si2 unit 3054, the halftone engine 55, and the si3 unit 57. Here, the functions and the configurations of the rendering engine 51, the si1 unit 52, the TRC 53, the halftone engine 55, and the si3 unit 57 are the same as those of the DFE 50 according to the first embodiment.

The si2 unit 3054 according to the present embodiment transmits, to the server device 3060, 8-bit gloss-control plane data on which a gamma correction has been performed by the TRC 53, 8-bit color plane data of CMYK, and a request to generate a clear toner plane and receives clear-toner plane data and the on/off information from the server device 3060.

Figure 32:
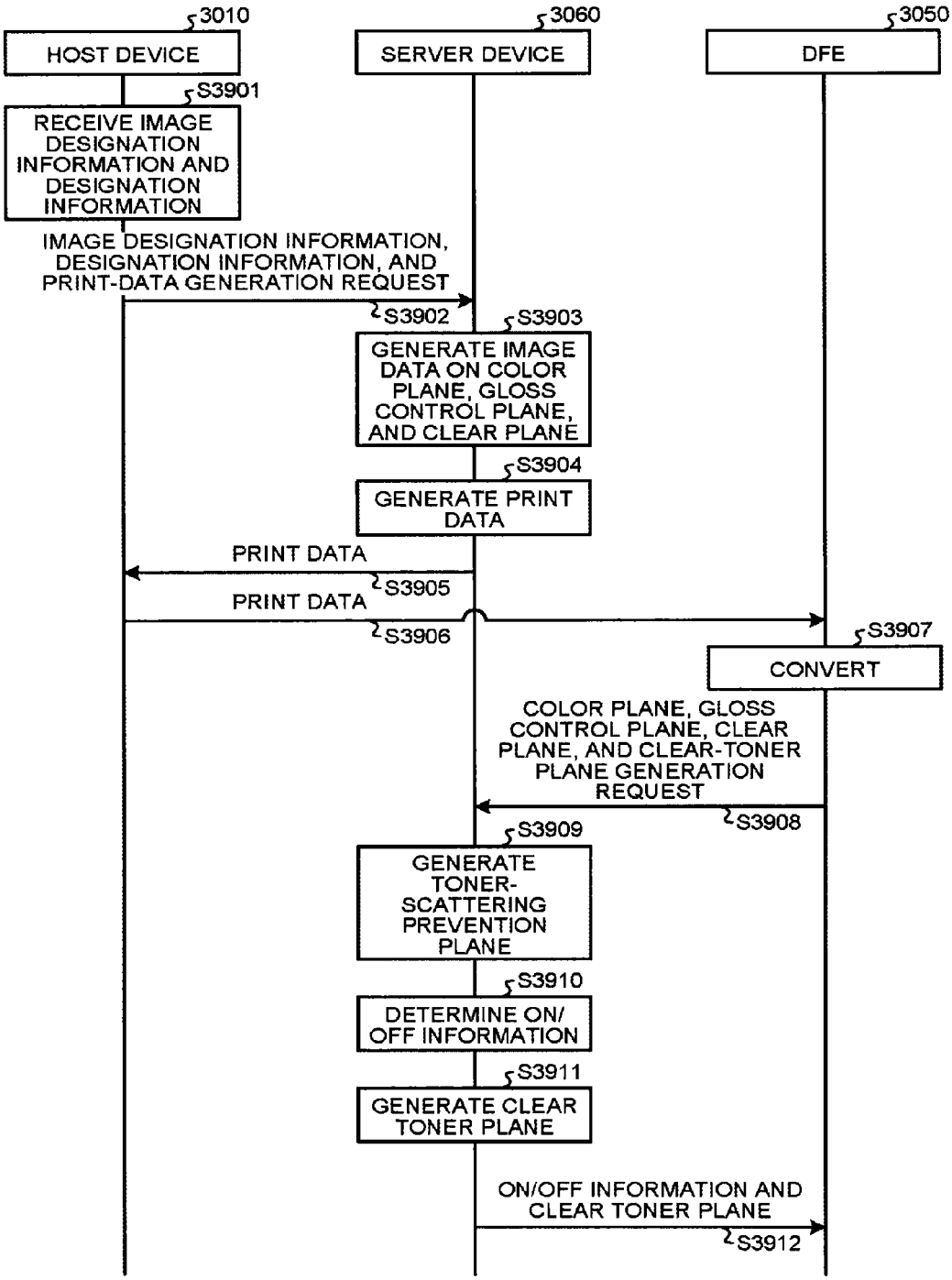
FIG. 32 is a sequence diagram that illustrates the overall flow of an operation to generate a clear toner plane.

Next, an explanation is given of an operation to generate a clear toner plane that is necessary for a printing operation that is performed by an image forming system that is configured as described above according to the present embodiment. FIG. 32 is a sequence diagram that illustrates the overall flow of an operation to generate a clear toner plane according to the sixth embodiment.

First, the host device 3010 receives, from a user, the image designation information and the designation information (Step S3901) and transmits, to the server device 3060, the print-data generation request together with the image designation information and the designation information (Step S3902).

The server device 3060 receives the print-data generation request together with the image designation information and the designation information and generates the image data on a color plane, the image data on a gloss control plane, and the image data on a clear plane (Step S3903). Then, the server device 3060 generates print data from the above image data (Step S3904) and transmits the generated print data to the host device 3010 (Step S3905).

After the host device 3010 receives the print data, it transmits the print data to the DFE 3050 (Step S3906).

After the DFE 3050 receives the print data from the host device 3010, it analyzes the print data, obtains the image data on the color plane, the image data on the gloss control plane, and the image data on the clear plane, and performs conversion, correction, or the like, on the image data (Step S3907). Then, the DFE 3050 transmits the image data on the color plane, the image data on the gloss control plane, the image data on the clear plane, and the request to generate the clear toner plane to the server device 3060 (Step S3908).

Next, after the server device 3060 receives the color plane data, the gloss-control plane data, the clear plane data, and the request to generate the clear toner plane, the toner-scattering prevention plane generating unit 3067 generates toner-scattering prevention plane data in the same manner as in the first embodiment (Step S3909). Next, the server device 3060 determines the on/off information (Step S3910) and generates the image data on a clear toner plane (Step S3911). Then, the server device 3060 transmits the generated clear-toner plane image data to the DFE 3050 (Step S3912).

The subsequent operations of the MIC 60, the printer device 70, the glosser 80, and the low-temperature fixing device 90 are performed in the same manner as in the first embodiment.

As described above, according to the present embodiment, the server device 3060 on the cloud performs the operations to generate color plane data, gloss-control plane data, clear plane data, print data, and clear-toner plane data and to generate toner-scattering prevention plane data; therefore, the same advantage as that in the first embodiment is produced and, even if there are the multiple host devices 3010 and the DFEs 3050, the density-value selection table and the surface-effect selection table can be collectively changed, or the like, and it is convenient for an administrator.

Furthermore, according to the present embodiment, a configuration is such that the single server device 3060 on the cloud is provided with the plane-data generating unit 3062, the print-data generating unit 3063, and the clear processing 3066, and the server device 3060 performs the plane-data generation operation to generate color plane data, clear plane data, and gloss-control plane data, the operation to generate print data, the operation to generate toner-scattering prevention plane data, and the operation to generate clear-toner plane data; however, this is not a limitation.

Figure 33:
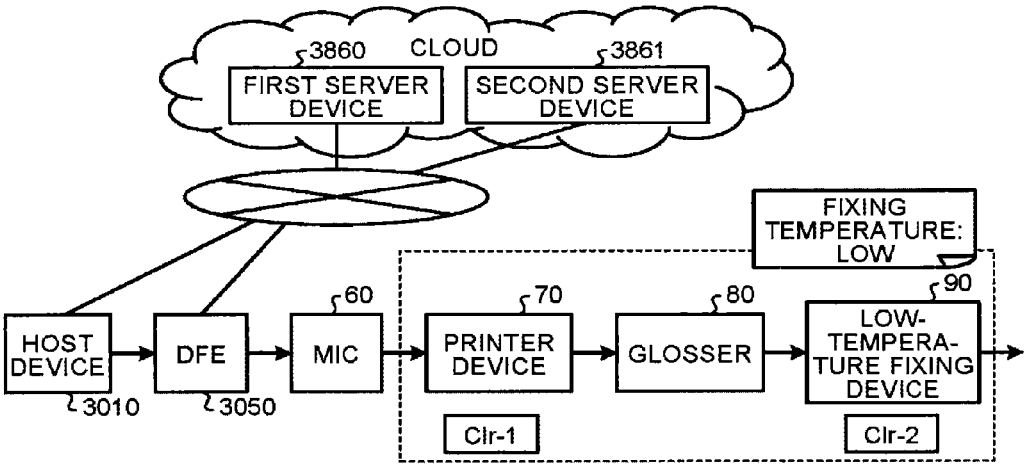
FIG. 33 is a configuration diagram of a network where two servers are provided on a cloud.

For example, a configuration may be such that two or more server devices are provided on the cloud and each of the above-described operations is separately performed by two or more server devices. FIG. 33 is a configuration diagram of a network where two servers (a first server device 3860 and a second server device 3861) are provided on a cloud. In the example of FIG. 33 a configuration is such that the first server device 3860 and the second server device 3861 separately perform the plane-data generation operation to generate color plane data, clear plane data, and gloss-control plane data, the operation to generate print data, the operation to determine the surface-effect selection table, and the operation to generate clear-toner plane data.

For example, a configuration may be such that the first server device 3860 is provided with the plane-data generating unit 3062 and the print-data generating unit 3063 so that the first server device 3860 performs the plane-data generation operation and the print-data generation operation, and a configuration may be such that the second server device 3861 is provided with the toner-scattering prevention plane generating unit 3067 and the clear processing 3066 so that the second server device 3861 performs the toner-scattering prevention plane data generation operation and the clear-toner plane data generation operation. Furthermore, the separation form of the operations to each server device is not limited to the above, and it may be performed arbitrarily.

Specifically, if the host device 10 and the DFE 50 have minimal configurations, it is optional that all or some of the plane-data generating unit 3062, the print-data generating unit 3063, the toner-scattering prevention plane generating unit 3067, and the clear processing 3066 may be collectively provided in a single server device on the cloud or may be separately provided in a plurality of server devices.

In other words, as in the above-described example, a configuration may be such that any of the operations performed by one device is performed by one or more different devices that are connected to the device via a network.

Furthermore, in the case of the above-described "configuration such that it is performed by one or more different devices that are connected to the device via a network", a configuration is such that an operation is performed to input and output data between one device and a different device and, furthermore, between different devices, for example, an operation to output, from one device to a different device, the data (information) that is generated during the operation performed by one device, an operation to input the data to a different device, or the like.

Specifically, if there is one different device, a configuration is such that an operation is performed to input and output data between one device and a different device, and if there are two or more different devices, a configuration is such that an operation is performed to input and output data between one device and a different device and between different devices, such as between a first different device and a second different device.

Furthermore, according to the present embodiment, the server device 3060 or multiple server devices, such as the first server device 3860 and the second server device 3861, are provided on the cloud; however, this is not a limitation. For example, a configuration may be such that the server device 3060 or multiple server devices, such as the first server device 3860 and the second server device 3861, are provided on any network, such as the Intranet.

Figure 34:
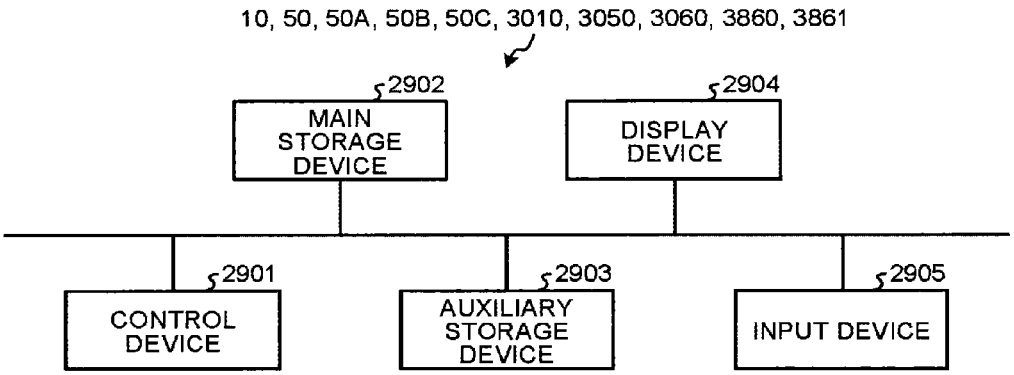
FIG. 34 is a diagram of the hardware configurations of host devices, DFEs, and server devices.

An explanation is given of the hardware configurations of the host devices 10, 3010, the DFEs 50, 3050, the server device 3060, the first server devices 3860, 3861, and the second server device 3861 according to the above described embodiment. FIG. 34 is a diagram of the hardware configurations of the host devices 10, 3010, the DFEs 50, 50A, 50B, 50C, 3050, and the server devices 3060, 3860, 6861. The host devices 10, 3010, the DFEs 50, 50A, 50B, 50C, 3050, the server device 3060, the first server device 3860, and the second server device 3861 principally includes, as the hardware configuration, a control device 2901, such as a CPU, that perform overall control of the device; a main storage device 2902, such as a ROM or RAM, that stores various types of data and various programs; an auxiliary storage device 2903, such as an HDD, that stores various types of data and various programs; an input device 2905, such as a keyboard or mouse; and a display device 2904, such as a display unit, and it has the hardware configuration that uses a typical computer.

The image processing program (it includes an image processing application. The same holds in the following) that is executed by the host devices 10, 3010 according to the above-described embodiment is provided as a computer program product by being stored, in the form of a file that is installable and executable, in a recording medium readable by a computer, such as a CD-ROM, a flexible disk (FD), a CD-R, or a digital versatile disk (DVD).

Furthermore, a configuration may be such that the image processing program that is executed by the host devices 10, 3010 according to the above-described embodiments is stored in a computer connected via a network, such as the Internet, and is provided by being downloaded via the network. Moreover, a configuration may be such that the image processing program that is executed by the host device 10 according to the above-described embodiment is provided or distributed via a network, such as the Internet.

Furthermore, a configuration may be such that the image processing program that is executed by the host devices 10, 3010 according to the above-described embodiment is provided such that it is installed in a ROM, or the like, in advance.

The image processing program that is executed by the host devices 10, 3010 according to the above-described embodiment has a modular configuration that includes the above-described units (the plane-data generating unit, the print-data generating unit, the input control unit, and the display control unit) and, in the actual hardware, a CPU (processor) reads the image processing program from the above-described storage medium and executes it, whereby the above-described units are loaded on the main storage device, and the plane-data generating unit, the print-data generating unit, the input control unit, and the display control unit are generated on the main storage device.

Furthermore, the printing control operation that is executed by the DFEs 50, 50A, 50B, 50C, 3050 according to the above-described embodiments may be implemented by using hardware or by using a printing control program that is software. In this case, the printing control program that is executed by the DFEs 50, 3050 according to the above-described embodiment is provided by being previously installed in a ROM, or the like.

A configuration may be such that the printing control program that is executed by the DFEs 50, 50A, 50B, 50C, 3050 according to the above-described embodiments is provided as a computer program product by being stored, in the form of a file that is installable and executable, in a recording medium readable by a computer, such as a CD-ROM, a flexible disk (FD), a CD-R, or a digital versatile disk (DVD).

Furthermore, a configuration may be such that the printing control program that is executed by the DFEs 50, 50A, 50B, 50C, 3050 according to the above-described embodiments is stored in a computer connected via a network, such as the Internet, and is provided by being downloaded via the network. Moreover, a configuration may be such that the printing control program that is executed by the DFE 50 according to the above-described embodiment is provided or distributed via a network, such as the Internet.

The printing control program that is executed by the DFEs 50, 50A, 50B, 50C, 3050 according to the above-described embodiment has a modular configuration that includes the above-described units (the rendering engine, the halftone engine, the TRC, the si1 unit, the si2 unit, the si3 unit, and the clear processing) and, in the actual hardware, a CPU (processor) reads the printing control program from the above-described ROM and executes it, whereby the above-described units are loaded on the main storage device, and the rendering engine, the halftone engine, the TRC, the si1 unit, the si2 unit, the si3 unit, and the clear processing are generated on the main storage device.

Furthermore, the operation performed by the server devices 3060, 3860, 3861 according to the above-described embodiments to generate the various types of data may be implemented by using hardware or by using a generation program that is software. In this case, the generation program that is executed by the server devices 3060, 3860, 3861 according to the above-described embodiment is provided by being previously installed in a ROM, or the like.

A configuration may be such that the processing program executed by the server devices 3060, 3860, 3861 according to the above-described embodiments to generate the various types of data is provided as a computer program product by being stored, in the form of a file that is installable and executable, in a recording medium readable by a computer, such as a CD-ROM, a flexible disk (FD), a CD-R, or a digital versatile disk (DVD).

Furthermore, a configuration may be such that the processing program executed by the server devices 3060, 3860, 3861 according to the above-described embodiments to generate the various types of data is stored in a computer connected via a network, such as the Internet, and is provided by being downloaded via the network. Moreover, a configuration may be such that the processing program executed by the server devices 3060, 3860, 3861 according to the above-described embodiments to generate the various types of data is provided or distributed via a network, such as the Internet.

The processing program executed by the above-described server devices 3060, 3860, 3861 to generate the various types of data has a modular configuration that includes the above-described units (the plane-data generating unit, the print-data generating unit, the toner-scattering prevention plane generating unit, and the clear processing) and, in the actual hardware, a CPU (processor) reads the generation program from the above-described ROM and executes it, whereby the above-described units are loaded on the main storage device, and the plane-data generating unit, the print-data generating unit, the toner-scattering prevention plane generating unit, and the clear processing are generated on the main storage device.

According to the above-described embodiments, a configuration is such that the image forming system includes the host devices 10, 3010, the DFEs 50, 50A, 50B, 50C, 3050, the MIC 60, the printer device 70, the glosser 80, and the low-temperature fixing device 90; however, this is not a limitation. For example, the DFEs 50, 50A, 50B, 50C, 3050, the MIC 60, and the printer device 70 may be integrally formed so as to be configured as a single image forming apparatus, and furthermore, it may be configured as the image forming apparatus that includes the glosser 80 and the low-temperature fixing device 90.

In the image forming system according to the above-described embodiment, an image is formed by using toner of multiple colors, i.e., CMYK; however, an image may be formed by using toner of one color.

Furthermore, a configuration is such that the printer system according to the above-described embodiment includes the MIC 60; however, this is not a limitation. A configuration may be such that the above-described operations and functions performed by the MIC 60 are performed by a different device, such as the DFE 50 and the MIC 60 is not provided.

According to an aspect of the present invention, an advantage is produced such that toner scattering over a white-on-color line drawing can be prevented while the color, size, or the like, of a drawing object is obtained as a user intended.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing control device comprising:

a toner-scattering prevention plane generating unit that determines whether a size of an outline drawing that is identified from target data for print is equal to or less than a predetermined size, and generates toner-scattering prevention plane data indicating that clear toner is applied to the outline drawing that is identified from the target data for print, in response to determining that the size of the outline drawing is equal to or less than the predetermined size, and does not generate the toner-scattering prevention plane data in response to determining that the size of the outline drawing is greater than the predetermined size; and an image-data generating unit that generates image data that includes the outline drawing by using the toner-scattering prevention plane data.

2. The printing control device according to claim 1, further comprising a specific-data generating unit that generates, from the target data for print, specific data indicating the identified outline drawing, wherein the toner-scattering prevention plane generating unit generates the toner-scattering prevention plane data by using the specific data.

3. The printing control device according to claim 1, wherein the image-data generating unit generates the image data by overlapping the toner-scattering prevention plane data and data for applying the clear toner for a different purpose.

4. The printing control device according to claim 1, further comprising a charging control unit that charges for application of the clear toner to an area other than the outline drawing and that does not charge for application of the clear toner to the outline drawing.

5. The printing control device according to claim 1, wherein the toner-scattering prevention plane generating unit generates the toner-scattering prevention plane data, in response to a density of a background of the outline drawing included in the target data for print being equal to or more than a predetermined density.

6. The printing control device according to claim 1, wherein the toner-scattering prevention plane generating unit does not generate the toner-scattering prevention plane data, in response to the target data for print indicating that application of the clear toner to the outline drawing is prevented.

7. A printing control device comprising:

a toner-scattering prevention plane generating unit that is implemented by circuitry and that determines whether a size of an outline drawing that is identified from target data for print is equal to or less than a predetermined size, and generates toner-scattering prevention plane data indicating that white toner is applied to the outline drawing that is identified from the target data for print, in response to determining that the size of the outline drawing is equal to or less than the predetermined size, and does not generate the toner-scattering prevention plane data in response to determining that the size of the outline drawing is greater than the predetermine size; and an image-data generating unit that is implemented by the circuitry and that generates image data that includes the outline drawing by using the toner-scattering prevention plane data.

8. The printing control device according to claim 7, wherein the image-data generating unit generates the image data by using the toner-scattering prevention plane data, the generated image data including, as the outline drawing, an expanded outline drawing that is obtained by expanding the outline drawing that is identified by the target data for print by a predetermined dot value.

9. The printing control device according to claim 7, further comprising:

a trapping-operation setting unit that is implemented by the circuitry and that receives an instruction to perform a trapping operation that forms, at a boundary of a drawing object included in the target data for print, an expanded area that is obtained by expanding the drawing object, and sets enabling information indicating that the trapping operation is enabled in response to the instruction; and a color-plane generating unit that is implemented by the circuitry and that generates color plane data indicating that color toner is applied to a color image included in the target data for print, wherein while the enabling information is set, the color-plane generating unit disables the trapping operation for an area corresponding to the outline drawing in the color image, and the image-data generating unit generates the image data that includes the outline drawing and the color image, by using the toner-scattering prevention plane data and the color plane data.

10. The printing control device according to claim 7, further comprising a color-plane generating unit that is implemented by the circuitry and that generates color plane data indicating that color toner is applied to an area corresponding to a color image included in the target data for print and an area corresponding to the outline drawing, wherein the image-data generating unit generates the image data that includes the outline drawing and the color image, by using the toner-scattering prevention plane data and the color plane data.

11. A printing control system comprising:

circuitry configured to determine whether a size of an outline drawing that is identified from target data for print is equal to or less than a predetermined size, generate toner-scattering prevention plane data indicating that clear toner is applied to the outline drawing that is identified from the target data for print, in response to determining that the size of the outline drawing is equal to or less than the predetermined size, and not generate the toner-scattering prevention plane data in response to determining that the size of the outline drawing is greater than the predetermined size, and generate image data that includes the outline drawing by using the toner-scattering prevention plane data.

12. The printing control system according to claim 11, wherein the circuitry is further configured to determine whether a density of a background of the outline drawing included in the target data for print is equal to or more than a predetermined density, in response to determining that the size of the outline drawing is equal to or less than the predetermined size.

13. The printing control system according to claim 12, wherein the circuitry is further configured to generate the toner-scattering prevention plane data, in response to determining that the density of the background of the outline drawing is equal to or more than the predetermined density and in response to determining that the size of the outline drawing is equal to or less than the predetermined size.

* * * * *